US011879337B2

(12) United States Patent
Danel et al.

(10) Patent No.: US 11,879,337 B2
(45) Date of Patent: Jan. 23, 2024

(54) THERMODYNAMIC CYCLE PROCESS PERFORMING TRANSFER BETWEEN MECHANICAL AND HEAT ENERGIES

(71) Applicant: SARUS SAS, Paris (FR)

(72) Inventors: Quentin Danel, Longueau (FR); Madhav Rathour, Créteil (FR)

(73) Assignee: SARUS, Paris (FR)

( * ) Notice: Subject to any disclaimer, the term of this patent is extended or adjusted under 35 U.S.C. 154(b) by 152 days.

(21) Appl. No.: 17/609,103

(22) PCT Filed: May 7, 2019

(86) PCT No.: PCT/IB2019/000564
§ 371 (c)(1),
(2) Date: Nov. 5, 2021

(87) PCT Pub. No.: WO2020/225583
PCT Pub. Date: Nov. 12, 2020

(65) Prior Publication Data

US 2022/0213790 A1 Jul. 7, 2022

(51) Int. Cl.
*F01B 11/00* (2006.01)

(52) U.S. Cl.
CPC ..... *F01B 11/007* (2013.01)

(58) Field of Classification Search
CPC ..... F01B 11/007; F01B 11/001; F01B 11/08; F01K 25/10; F01K 15/00; F01K 7/36
See application file for complete search history.

(56) References Cited

U.S. PATENT DOCUMENTS 2,988,874 A 6/1961 Edward et al.
3,540,348 A 11/1970 Pennther
(Continued)

FOREIGN PATENT DOCUMENTS

DE 10 2014 100545 7/2015
JP 2011-127879 A 6/2011

OTHER PUBLICATIONS

International Search Report for PCT/IB2019/000564 dated Feb. 4, 2020, 4 pages.
(Continued)

*Primary Examiner* — Jacob M Amick
*Assistant Examiner* — Charles J Brauch
(74) *Attorney, Agent, or Firm* — NIXON & VANDERHYE

(57) ABSTRACT

Disclosed is a thermodynamic cycle process, performing transfer between mechanical and heat energies, by changing a state of a fluid, including: an expansion of the fluid, an energy retrieval from the fluid expansion, a step of powering a liquid pump or a gas compressor with the retrieved energy, using a cyclic free piston expander which alternatively changes direction of the free piston sliding: by alternatively: closing the fluidic communication between the both opposite sides of the free piston, to make different from each other the pressures applied respectively thereon, so the free piston slides in a first direction, opening a fluidic communication between both opposite sides of the free piston, to make equal to each other the pressures applied respectively thereon, so the free piston slides in a second direction opposite to the first direction, the free piston sliding, directly and mechanically, opening and closing, the fluidic communication.

31 Claims, 16 Drawing Sheets

(56) References Cited

U.S. PATENT DOCUMENTS

| | | | | |
|---|---|---|---|---|
| 4,208,885 | A * | 6/1980 | Schmerzler | F25B 1/10 62/403 |
| 4,747,271 | A | 5/1988 | Fischer | |
| 5,765,374 | A | 6/1998 | Hansen | |

OTHER PUBLICATIONS

Written Opinion of the ISA for PCT/IB2019/000564 dated Feb. 4, 2020, 6 pages.

* cited by examiner

THERMODYNAMIC CYCLE PROCESS PERFORMING TRANSFER BETWEEN MECHANICAL AND HEAT ENERGIES

This application is the U.S. national phase of International Application No. PCT/IB2019/000564 filed May 7, 2019 which designated the U.S., the entire content of which is hereby incorporated by reference.

FIELD OF THE INVENTION

The invention relates to the field of thermodynamic cycle process, performing transfer between mechanical and heat energies, by changing a state of a fluid.

BACKGROUND OF THE INVENTION

According to a first classical prior art, it is known a thermodynamic cycle process comprising a fluid expansion performed by an expansion valve. However, the energy produced during this fluid expansion is lost.

According to a second prior art, for example described in U.S. Pat. No. 4,208,885, or for example described in JP 2011127879, it is known a thermodynamic cycle process using a cyclic free piston expander to retrieve energy from this fluid expansion. However, this thermodynamic cycle process using this cyclic free piston expander uses either two different fluid flows or one fluid flow with one or more opening and closing valves so as to push it in two opposite sliding directions. Hence, this makes its control mechanism too complex and/or too fragile to alternatively change the sliding directions for the free piston sliding.

SUMMARY OF THE INVENTION

The object of the present invention is to alleviate at least partly the above mentioned drawbacks.

It is an object of the invention to propose an improvement of such a control mechanism in order to make it simpler and/or more robust, thereby improving the compromise between simplicity and robustness for the control mechanism of the cyclic free piston expander used by the thermodynamic cycle process, while keeping efficient the energy retrieval from expansion.

Therefore, the invention proposes a modification of a thermodynamic cycle process using a cyclic free piston expander both by introducing into free piston expander a fluidic communication between its two surfaces alternatively so as to push it in two opposite sliding directions with a single fluid flow and by making very simple and robust the mechanism to alternatively open and close this fluidic communication so as to control in a simple and efficient way the alternative change of sliding directions for the free piston sliding.

This object is achieved with a thermodynamic cycle process, performing transfer between mechanical and heat energies, by changing a state of a fluid, comprising: an expansion of said fluid, an energy retrieval from said fluid expansion, a step of powering a liquid pump or a gas compressor with said retrieved energy, using a cyclic free piston expander which alternatively changes direction of said free piston sliding: by alternatively: closing said fluidic communication between said both opposite sides of said free piston, so as to make different from each other the pressures applied respectively thereon, so that said free piston then slides in a first direction, opening a fluidic communication between both opposite sides of said free piston, so as to make equal to each other the pressures applied respectively thereon, so that said free piston then slides in a second direction opposite to said first direction, said free piston sliding, directly and mechanically, opening and closing, said fluidic communication.

The free piston sliding, directly and mechanically, opening and closing, said fluidic communication, means, first that it is the sliding itself of the free piston which opens and closes the fluidic communication, not by an intermediate control mechanism detecting the sliding of the free piston, and second that the action of the free piston sliding which directly opens or closes the fluidic communication is a mechanical action and not a mechanical trigger of another non mechanical action like would be the trigger of an electric or electronic actuator. Indeed, it is the sliding of the free piston which opens and closes the fluidic communication, in a direct and mechanical way.

According to embodiments of the invention, neither valve, nor other distribution mechanism, nor any other control system, is needed.

Preferably, indeed, this object is achieved with a thermodynamic cycle process, performing transfer between mechanical and heat energies, by changing a state of a fluid, comprising: an expansion of said fluid, an energy retrieval from said fluid expansion, a step of powering a liquid pump or a gas compressor with said retrieved energy, using a cyclic free piston expander which comprises a free piston sliding in a sliding chamber, which free piston comprises a free piston head and a free piston pin or rod, and which alternatively changes direction of said free piston sliding: by alternatively: closing said fluidic communication between said both opposite sides of said free piston head, so as to make different from each other the pressures applied respectively thereon, so that said free piston then slides in a first direction, opening a fluidic communication between both opposite sides of said free piston head, so as to make equal to each other the pressures applied respectively thereon, so that said free piston then slides in a second direction opposite to said first direction, said free piston sliding, directly and mechanically, opening and closing, said fluidic communication. This helps making opening and closing of the fluidic communication simpler and more automatic, the simple sliding of free piston changing position of the end of fluidic communication being open and closed, respectively by sliding in a portion of the chamber with increased internal diameter and a portion of the chamber with reduced internal diameter.

Preferably, in one embodiment, said fluidic communication is closed and open, respectively by an end of an admission channel located within the free piston and sliding against the sliding chamber wall with a reduced diameter and by same end of the admission channel opening into a space with an increased diameter of a sliding chamber wall.

Preferably, in another embodiment, said fluidic communication is closed and open, respectively by an end of an admission channel located within the sliding chamber wall and relatively sliding against the free piston head and by same end of the admission channel opening into a space with an increased diameter of a sliding chamber wall.

Preferred embodiments comprise one or more of the following features, which can be taken separately or together, either in partial combination or in full combination, with the previous object of the invention or with one or more of the preferred options related to the previous object of the invention.

Preferably, said fluidic communication includes one or more, preferably only one, communicating channel(s) located within the body of said free piston.

Hence, the compromise between simplicity and robustness for the control mechanism of the cyclic free piston expander used by the thermodynamic cycle process is still more improved, since the communicating channel which is a fragile element per se is well protected by its location within the bulky body of the free piston itself.

Preferably, said communicating channel is a bent channel, has a major part of its length, preferably at least 70%, extending axially with respect to said sliding directions of said free piston, preferably extending along a symmetry axis of said free piston, and has a minor part of its length, preferably at most 30%, extending radially with respect to said sliding directions of said free piston.

Hence, the free piston remains well balanced, during all its sliding, in either of first and second directions.

Preferably, axial length end of said communicating channel opens into said expansion space, radial length end of said communicating channel: opens into said admission space at end of free piston sliding stroke when said free piston slides in said first direction, leads against sliding chamber wall during the major part of free piston sliding stroke from beginning when said free piston slides in said first direction, opens into said admission space at beginning of free piston sliding stroke when said free piston slides in said second direction, leads against sliding chamber wall during the major part of free piston sliding stroke until end when said free piston slides in said second direction.

Hence, opening of this radial length end of the communicating channel into the admission space is enough to start braking the free piston sliding in the first direction, before inverting this free piston sliding in the second direction, and closing of this radial length end of the communicating channel by the sliding chamber wall is enough to start braking the free piston sliding in the second direction, once internal pressure of expansion space has dropped by opening exhaust outlet, before inverting this free piston sliding in the first direction.

Preferably, said free piston slides within a sliding chamber, said fluidic communication includes one or more, preferably only one, communicating channel(s) located within the wall of said sliding chamber.

Hence, the free piston is more balanced than in former case where the communicating channel was located within the bulky body of the piston itself, but the required volume in the sliding chamber wall is somewhat bigger, at least in one radial direction.

Preferably, said communicating channel is a doubly bent channel, has a major part of its length, preferably at least 55%, extending axially with respect to said sliding directions of said free piston, and has a minor part of its length, preferably at most 45%, extending radially with respect to said sliding directions of said free piston.

Hence, the required volume in the sliding chamber wall to locate the communicating channel is somewhat lower.

Preferably, axial length of said communicating channel is located between two radial lengths of said communicating channel, end of one radial length of said communicating channel: opens into said expansion space at end of free piston sliding stroke in said first direction, end of the other radial length of said communicating channel: opens into said admission space at end of free piston sliding stroke when said free piston slides in said first direction, leads against free piston external wall during the major part of free piston sliding stroke from beginning when said free piston slides in said first direction, opens into said admission space at beginning of free piston sliding stroke when said free piston slides in said second direction, leads against free piston external wall during the major part of free piston sliding stroke until end when said free piston slides in said second direction.

Hence, opening of one of these radial length ends of the communicating channel into the admission space is enough to start braking the free piston sliding in the first direction, before inverting this free piston sliding in the second direction, and closing of this same radial length end of the communicating channel by the sliding chamber wall is enough to start braking the free piston sliding in the second direction, once internal pressure of expansion space has dropped by opening exhaust outlet, before inverting this free piston sliding in the first direction.

Preferably, in said step of powering a liquid pump or a gas compressor with said retrieved energy, said cyclic free piston expander alternatively changes direction of said free piston sliding: by alternatively: closing said fluidic communication between said both opposite sides of said free piston, so as to make different from each other the pressures applied respectively thereon, so that said free piston then slides and accelerates in a first direction, opening a fluidic communication between both opposite sides of said free piston, so as to make equal to each other the pressures applied respectively thereon, so that said free piston then slides and accelerates in a second direction opposite to said first direction, said free piston sliding and accelerating, directly and mechanically, opening and closing, said fluidic communication.

Hence, since said free piston is not only sliding but also accelerating, the momentum acquired by the free piston helps the free piston stroke to be longer and the alternation between opening and closing the fluidic communication to be more dynamic.

Preferably, toward a first direction of said free piston sliding, a first pressure is applied on a first surface of a first side of said free piston, toward a second direction of said free piston sliding, a second pressure is applied on a second surface of a second side of said free piston opposite to said first side, said first surface being smaller than said second surface, a ratio between said first surface and said second surface being preferably less than 70%, first product of said first pressure by said first surface being higher than second product of said second pressure by said second surface, during a major part of said free piston sliding stroke in said first direction, preferably during most of said free piston sliding stroke in said first direction, first product of said first pressure by said first surface being lower than second product of said second pressure by said second surface, during a major part of said free piston sliding stroke in said second direction, preferably during most of said free piston sliding stroke in said second direction.

Hence, the compromise between simplicity and robustness for the control mechanism of the cyclic free piston expander used by the thermodynamic cycle process is still better improved, since this size difference between first and second surfaces allows, not only for using the same fluid flow to switch between the two sliding directions of the free piston, but also for using this same fluid flow without modifying the way or the intensity to apply it on the first surface of the free piston and without associated modifying mechanism to do so.

Preferably, said free piston slides within a sliding chamber, said first surface of said free piston is in an admission space of said sliding chamber having a first variable volume, said second surface of said free piston is in an expansion space of said sliding chamber having a second variable volume, said second volume decreasing when said first volume increases and said second volume increasing when said first volume decreases.

Hence, this is quite a simple mechanism for the free piston to perform the alternation between opening and closing the fluidic communication.

Preferably, said free piston includes a shoulder reducing its diameter, said free piston shoulder being said first surface, said sliding chamber comprises a shoulder reducing its diameter, said admission space is located between said free piston shoulder and said sliding chamber shoulder.

Hence, the admission space is located on the periphery of the free piston, and therefore can more easily be connected to an outside compressed fluid flow.

Preferably, said admission space has the shape of an annular compartment of a height which is variable and which height direction is parallel to said sliding directions of said free piston.

Hence, the direction of the thrust provided by such an admission space first is parallel to the direction of the free piston sliding and second is well distributed around this direction of the free piston sliding. This makes the control mechanism of the cyclic free piston expander used by the thermodynamic cycle process still more efficient and better balanced, thereby more robust over time.

Preferably, said admission space is connected to an outside compressed fluid flow, via a simple and preferably via a single inlet through a wall of the sliding chamber, said inlet being preferably located so as to remain open during all free piston sliding.

Hence, the compromise between simplicity and robustness for the control mechanism of the cyclic free piston expander used by the thermodynamic cycle process is still better improved, since transmission of compressed fluid flow toward admission space is made shorter and simpler.

Preferably, said expansion space is located between on a one hand a free side of a head of said free piston, said free piston head being opposite to a pin of said free piston, a free side of said free piston pin either exerting a force toward pumping liquid of said liquid pump or toward compressing gas of said gas compressor at an open extremity of said sliding chamber, and on the other hand a closed extremity of said sliding chamber. Free piston pin preferably has the shape of a free piston rod.

Hence, the direction of the thrust provided by such an expansion space first is parallel to the direction of the free piston sliding and second takes advantage of the whole free piston head surface available. This makes the control mechanism of the cyclic free piston expander used by the thermodynamic cycle process still more efficient.

Preferably, said expansion space is connected to an outside expanded fluid flow, via a simple and preferably via a single outlet through a wall of the sliding chamber, said outlet being preferably located so as to remain closed during a major part of said free piston sliding stroke, preferably during more than 80% of said free piston sliding stroke.

Hence, the compromise between simplicity and robustness for the control mechanism of the cyclic free piston expander used by the thermodynamic cycle process is still more improved, since transmission to expanded fluid flow from expansion space is made shorter and simpler.

Preferably, said free piston expander, which is located between a compressed fluid flow and an expanded fluid flow of the thermodynamic cycle process, has all of its pieces which are static except only one piece which is moving, that is the free piston which slides within the static sliding chamber.

Hence, the compromise between simplicity and robustness for the control mechanism of the cyclic free piston expander used by the thermodynamic cycle process is well optimized.

Preferably, said fluid is: water, or carbon dioxide, or air, or natural gas, or organic fluid, or ammoniac ($NH_3$), or any mixture comprising carbon dioxide, and/or air, or and/natural gas, or organic fluid, and/or ammoniac ($NH_3$), or any mixture comprising water and/or ethanol and/or any organic fluid.

Preferably, said fluid is carbon dioxide.

Hence, the global efficiency of the thermodynamic cycle process is even higher.

Preferably, said free piston pin either exerting a force toward pumping liquid of said liquid pump or toward compressing gas of said gas compressor at an open extremity of said sliding chamber via an extension arm sliding in a tube having a smaller internal diameter than an internal diameter of said sliding chamber, a ratio of said internal diameter of said tube by said internal diameter of said sliding chamber being preferably less than 60% and advantageously more than 20%.

Hence, the stroke of the pumping or of the compressing is longer and multiplied as compared to the stroke of the free piston sliding.

Preferably, a ratio of a fluid high pressure before said fluid expansion by a fluid low pressure after fluid expansion, is greater than 20, preferably greater than 30, more preferably greater than 40.

Hence, this thermodynamic cycle process works well even for very high expansion ratio.

Preferably, a fluid high pressure before said fluid expansion, is greater than 50 bars, preferably greater than 80 bars, more preferably greater than 100 bars.

Hence, this thermodynamic cycle process works well even for very high fluid pressures before fluid expansion.

Preferably, said free piston sliding has an oscillation frequency, said free piston has a mass which has a value such that said oscillation frequency ranges from 20 Hz to 150 Hz, preferably ranges from 30 Hz to 120 Hz, more preferably ranges from 50 Hz to 90 Hz.

Hence, this is an optimized compromise between on one hand the global efficiency of the thermodynamic cycle process and on the other hand the mechanical resistance of the whole structure kept as simple and as robust over time as possible.

Preferably, a fluid temperature during said fluid expansion, goes under 80° C., preferably 0° C., more preferably −40° C. Temperature may range for instance from −40° C. to 10° C. for refrigeration and for heat pump. Temperature may range for instance from 30° C. to 80° C. for use of ORC cycle.

Preferably, a fluid temperature during said fluid expansion, goes under −100° C., preferably under −150° C.

Hence, this thermodynamic cycle process works well even for very low fluid temperatures during fluid expansion.

Preferably, said powering step powers a positive displacement pump or a positive displacement compressor with said retrieved energy.

Thermodynamic cycle process according to the invention is especially efficient for positive displacement pump or a positive displacement compressor having a more important fluid compression.

Preferably, the thermodynamic cycle includes a phase of adiabatic expansion.

Hence, the proportion of retrieved energy is somewhat higher.

Preferably, said adiabatic expansion phase is more than a half of the whole expansion phase.

Hence, the proportion of retrieved energy is even higher.

Preferably, at the beginning of said adiabatic expansion phase, said fluid is: in a liquid state, or in a mixed state including both liquid and vapor, or in a super-critical fluid state.

Preferably, at the beginning of said adiabatic expansion phase, said fluid is in a super-critical fluid state.

Hence, the global efficiency of the thermodynamic cycle process is even higher.

Preferably, said thermodynamic cycle process is used: in a refrigerator, or in a heat pump, or in an air conditioner.

Preferably, said thermodynamic cycle process includes a main powering step, said powering step of said free piston expander is re-used to perform part of said main powering step in said thermodynamic cycle process.

Hence, the retrieved energy is directly reused.

Preferably, said thermodynamic cycle process comprises a compression step, in said powering step, a compressing portion of said free piston expander performs part of said compression step, said free piston expander compressing portion being preferably disposed in parallel to a compressor performing major part of said compression step, or said free piston expander compressing portion being preferably disposed in series to a compressor performing major part of said compression step.

Preferably, said thermodynamic cycle process is: a Rankine cycle, or an organic Rankine cycle.

Further features and advantages of the invention will appear from the following description of embodiments of the invention, given as non-limiting examples, with reference to the accompanying drawings listed hereunder.

DETAILED DESCRIPTION OF THE INVENTION

In the following text, unless explicitly stated to the contrary, "connected" means "fluidically connected" i.e. connected together such that a fluid may go from one to the other.

Figure 1:
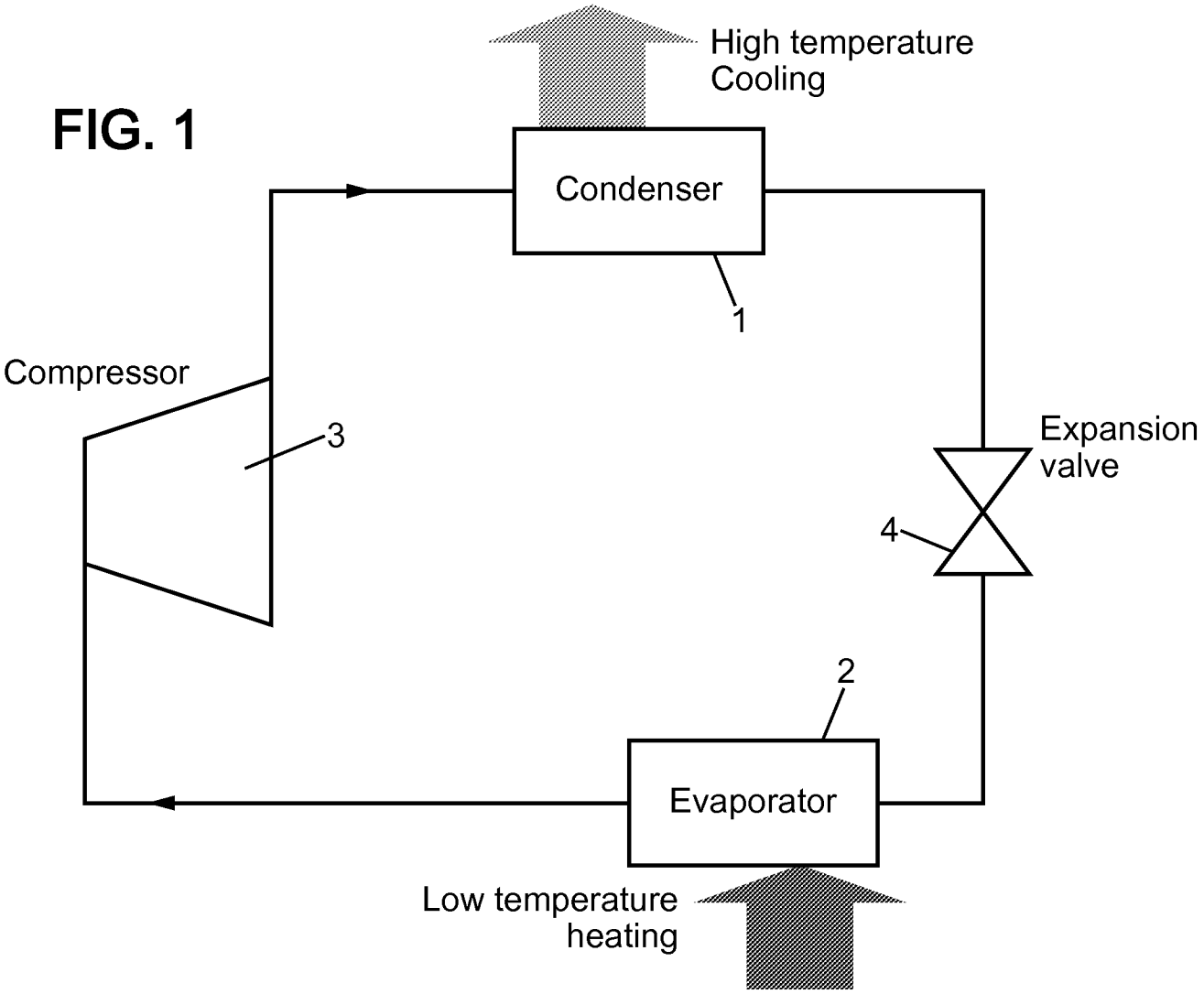
FIG. 1 shows an application to a heat pump or to a refrigerating machine of a thermodynamic cycle process according to first classical prior art, with a simple expansion valve.

FIG. 1 shows an application to a heat pump or to a refrigerating machine of a thermodynamic cycle process according to first classical prior art, with a simple expansion valve.

The thermodynamic machine comprises a condenser 1 connected to both a compressor 3 and an expansion valve 4. The thermodynamic machine also comprises an evaporator 2 connected to both the compressor 3 and the expansion valve 4. The compressor 3 compresses a gas at low pressure coming from the evaporator 2 and sends this gas at high pressure toward the condenser 1. The condenser 1 changes the gas into liquid and sends the liquid toward the expansion valve 4. The expansion valve 4 sends the liquid, after being expanded, toward the evaporator 2 which changes the liquid into gas. The condenser 1 performs a high temperature cooling. The evaporator 2 performs a low temperature heating. An external source of energy, not represented, is powering the compressor 3.

Figure 2:
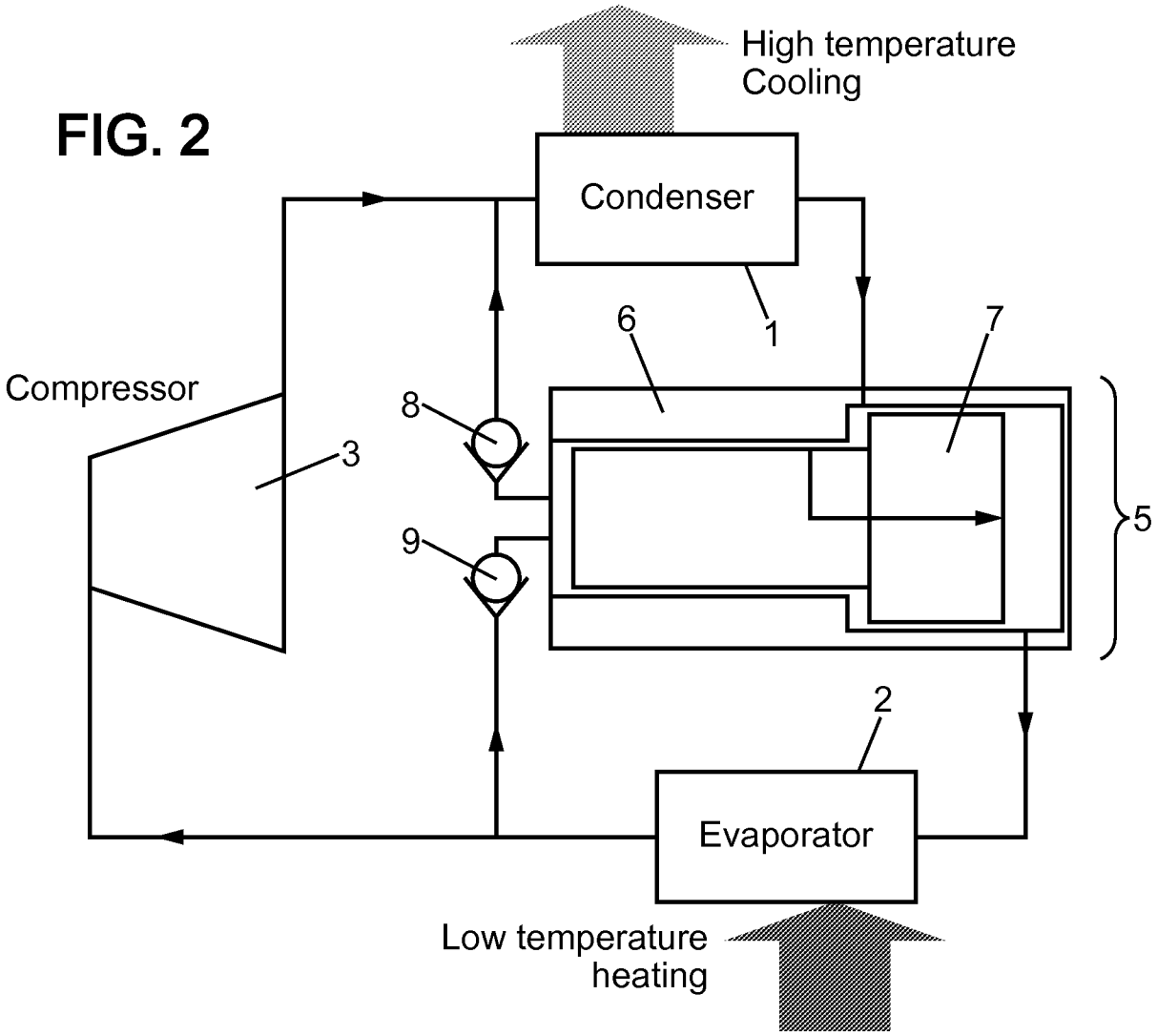
FIG. 2 shows an example of an application to a heat pump or to a refrigerating machine of a thermodynamic cycle process according to an embodiment of the invention, with a free piston expander disposed in parallel with a compressor.

FIG. 2 shows an example of an application to a heat pump or to a refrigerating machine of a thermodynamic cycle process according to an embodiment of the invention, with a free piston expander disposed in parallel with a compressor. The thermodynamic cycle process is used for example either in a refrigerator, or in a heat pump, or in an air conditioner.

The thermodynamic machine comprises a condenser 1 connected to both a compressor 3 and a free piston expander 5 including a free piston 7 sliding in a sliding chamber 6. The condenser 1 is connected to the free piston expander 5 energy powering stage directly and to the free piston expander 5 energy providing stage via a high pressure valve 8.

The thermodynamic machine comprises an evaporator 2 connected to both the compressor 3 and the free piston expander 5. The evaporator 2 is connected to the free piston expander 5 energy powering stage directly and to the free piston expander 5 energy providing stage via a low pressure valve 9. Free piston expander 5 can provide energy at its energy providing stage because he receives energy that it retrieves from the fluid expansion of the thermodynamic machine.

The compressor 3 compresses a gas at low pressure coming from the evaporator 2 and sends this gas at high pressure toward the condenser 1. An external source of energy, not represented, is powering the compressor 3. The free piston expander 5 helps the compressor 3 to compress the gas at low pressure coming from the evaporator 2 and to send this gas at high pressure toward the condenser 1. Therefore, less energy is required from the external source of energy to power the compressor 3. The free piston expander 5 is disposed in parallel to the compressor 3.

The condenser 1 changes the gas into liquid and sends the liquid toward the free piston expander 5. The free piston expander 5 sends the liquid, after being expanded, toward the evaporator 2 which changes the liquid into gas. The condenser 1 performs a high temperature cooling. The evaporator 2 performs a low temperature heating.

For example, a ratio of a fluid high pressure before fluid expansion by a fluid low pressure after fluid expansion, can be greater than 20, greater than 30, greater than 40.

For example, a fluid high pressure before fluid expansion, can be greater than 50 bars, greater than 80 bars, greater than 100 bars.

For example, a fluid temperature during fluid expansion, can go under −100° C., even under −150° C.

Figure 3:
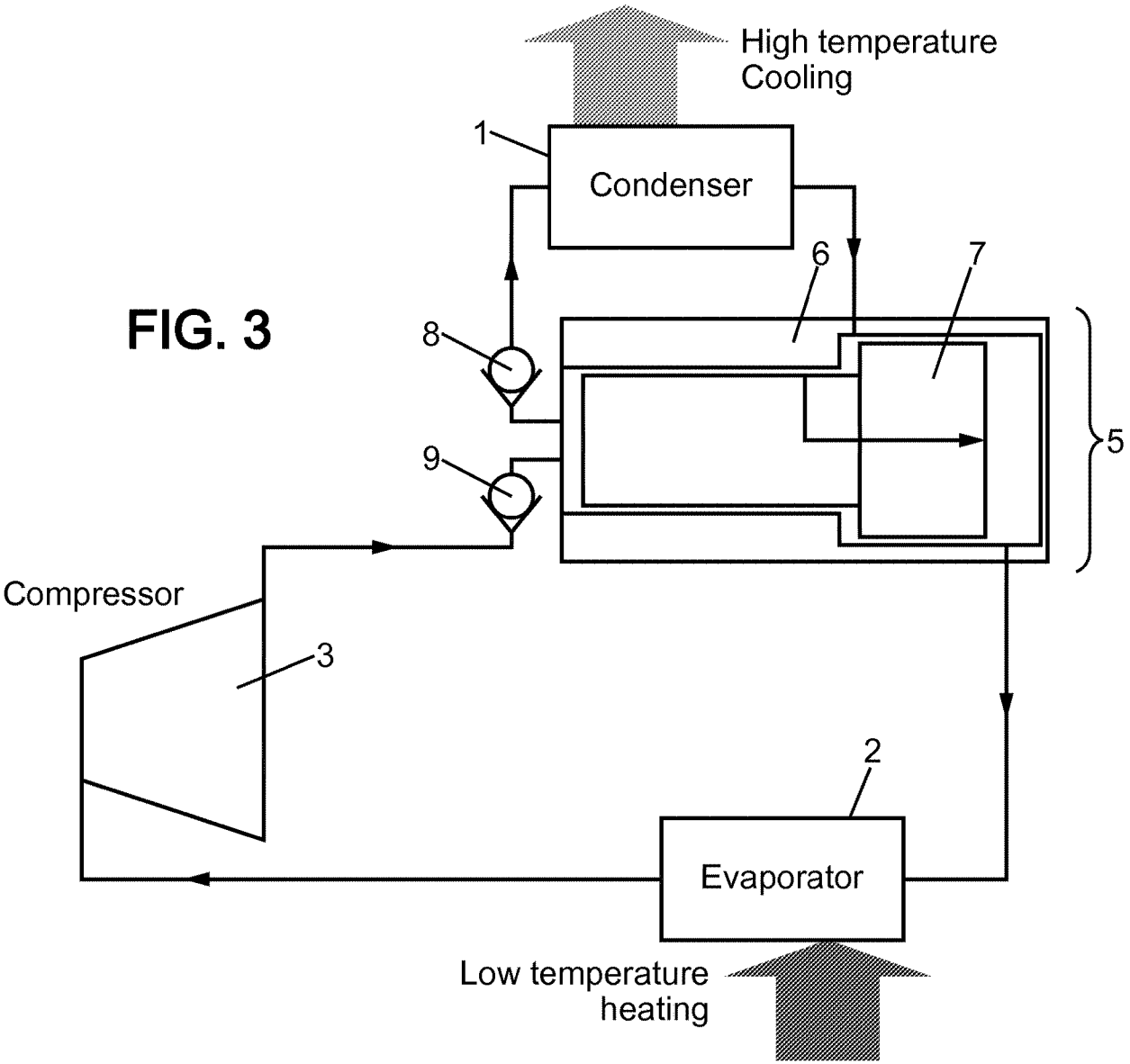
FIG. 3 shows another example of an application to a heat pump or to a refrigerating machine of a thermodynamic cycle process according to an embodiment of the invention, with a free piston expander disposed in series with a compressor.

FIG. 3 shows another example of an application to a heat pump or to a refrigerating machine of a thermodynamic cycle process according to an embodiment of the invention, with a free piston expander disposed in series with a compressor.

The thermodynamic machine comprises a condenser 1 connected to a free piston expander 5. The condenser 1 is connected to the free piston expander 5 energy powering stage directly and to the free piston expander 5 energy providing stage via a high pressure valve 8.

The thermodynamic machine comprises an evaporator 2 connected to both the compressor 3 and the free piston expander 5. The evaporator 2 is connected to the free piston expander 5 energy powering stage directly. The compressor 3 is also connected to the free piston expander 5 energy providing stage via a low pressure valve 9.

The compressor 3 compresses a gas at low pressure coming from the evaporator 2 and sends this gas at high pressure toward the low pressure valve 9. An external source of energy, not represented, is powering the compressor 3. The free piston expander 5 helps the compressor 3 to compress the gas at low pressure coming from the compressor 3 via low pressure valve 9 and to send this gas at high pressure toward the condenser 1 via high pressure valve 8. Therefore, less energy is required from the external source of energy to power the compressor 3. The free piston expander 5 is disposed in series to the compressor 3.

The condenser 1 changes the gas into liquid and sends the liquid toward the free piston expander 5. The free piston expander 5 sends the liquid, after being expanded, toward the evaporator 2 which changes the liquid into gas. The condenser 1 performs a high temperature cooling. The evaporator 2 performs a low temperature heating.

Figure 4:
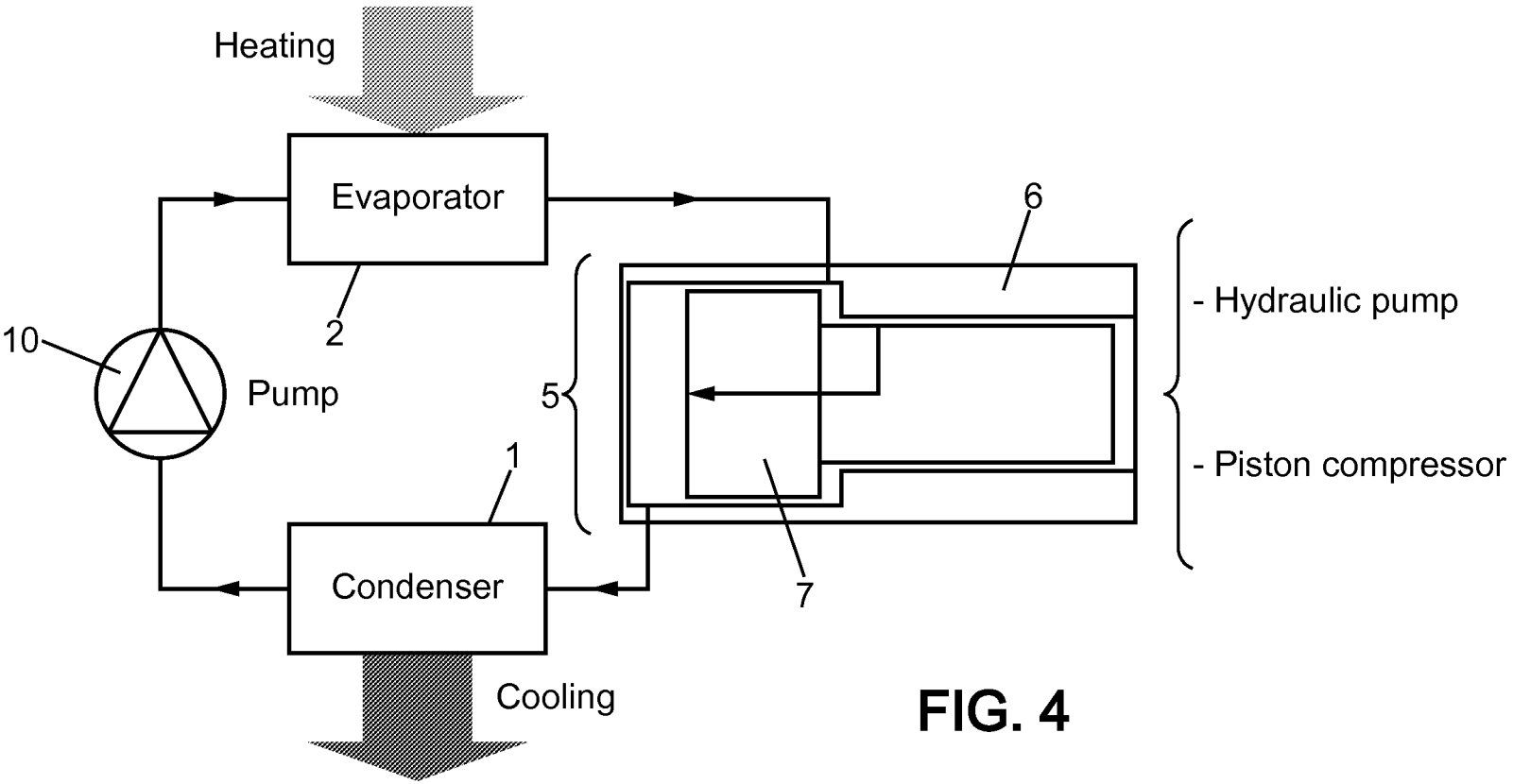
FIG. 4 shows another example of an application to an organic Rankine cycle or to a Rankine cycle of a thermodynamic cycle process according to an embodiment of the invention, with a free piston expander powering a hydraulic pump or a piston compressor.

FIG. 4 shows another example of an application to an organic Rankine cycle or to a Rankine cycle of a thermodynamic cycle process according to an embodiment of the invention, with a free piston expander powering a hydraulic pump or a piston compressor.

The thermodynamic machine comprises a condenser 1 connected to both a pump 10 and a free piston expander 5 including a free piston 7 sliding in a sliding chamber 6. The condenser 1 is connected to the free piston expander 5 energy powering stage directly. The free piston expander 5 energy providing stage can be connected either to a hydraulic pump or to a piston compressor, both not represented on the figure. This connection from free piston expander 5 either to a hydraulic pump or to a piston compressor may be either direct or via a rod capable of transmitting mechanical effort.

The thermodynamic machine comprises an evaporator 2 connected to both the pump 10 and the free piston expander 5. The evaporator 2 is connected to the free piston expander 5 energy powering stage directly.

The pump 10 pumps a liquid coming from condenser 1 and sends this liquid toward the evaporator 2. An external source of energy, not represented, is powering the pump 10. The free piston expander 5 provides energy toward either a hydraulic pump or toward a piston compressor. Heat, coming for example from waste heat recovery or from solar heating or from biomass combustion, is brought to the evaporator 2. The condenser 1 provides cooling.

The condenser 1 changes the gas coming from the free piston expander 5 into liquid and sends the liquid toward the pump 10. The pump 10 sends the liquid toward the evaporator 2 which changes the liquid into gas. The free piston expander 5 receives gas at high pressure coming from the evaporator 2, and sends gas at low pressure toward the condenser 1, gas being expanded when going through the free piston expander 5.

Figure 5:
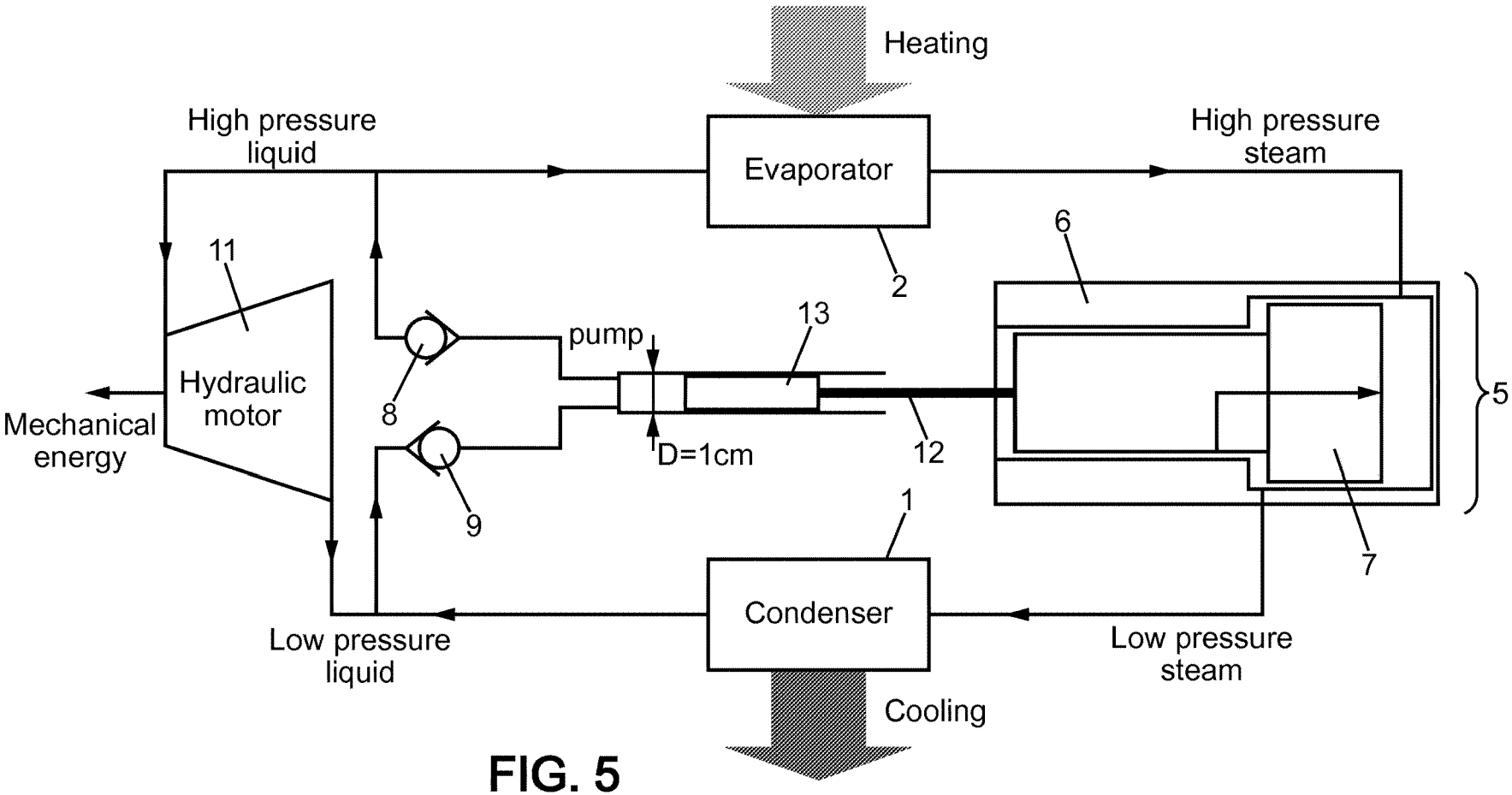
FIG. 5 shows another example of an application to an organic Rankine cycle or to a Rankine cycle of a thermodynamic cycle process according to an embodiment of the invention, with the free piston expander disposed in parallel with a hydraulic motor.

FIG. 5 shows another example of an application to an organic Rankine cycle or to a Rankine cycle of a thermodynamic cycle process according to an embodiment of the invention, with the free piston expander disposed in parallel with a hydraulic motor.

The thermodynamic machine comprises a condenser 1 providing cooling to outside and an evaporator 2 receiving heating from outside (for example from an external heat source).

The evaporator 2 is connected to both a hydraulic motor 11 providing mechanical energy toward outside and a free piston expander 5 including a free piston 7 sliding in a sliding chamber 6, this free piston 7 being connected by a rod 12 to a pump 13 energy powering stage, the rod 12 transmitting mechanical effort from free piston 7 to pump 13. This pump 13 has a diameter D which is reduced as compared to the diameter of free piston 7 rod at its energy providing stage, the diameter D is for example of 1 cm, as compared to a diameter of free piston comprised between 2 and 3 cm, hence a reduction factor ranging from 2 to 3. The evaporator 2 is connected to the free piston expander 5 energy powering stage directly. The evaporator 2 is connected to the pump 13 energy providing stage via a high pressure valve 8.

The condenser 1 is connected to both the hydraulic motor 11 and the free piston expander 5. The evaporator 2 is connected to the free piston expander 5 energy powering stage directly. The evaporator 2 is connected to the pump 13 energy providing stage via a low pressure valve 9.

The pump 13 pumps a liquid at low pressure coming both from the condenser 1 and the hydraulic motor 11 via low pressure valve 9, and sends it at high pressure both toward the evaporator 2 and toward the hydraulic motor 11 via high pressure valve 8.

The condenser 1 changes the gas coming from free piston expander 5 energy powering stage into liquid and sends the liquid toward the low pressure valve 9. The evaporator 2 changes the liquid into gas and then sends the gas at high pressure toward the free piston expander 5 energy powering stage where this high pressure gas is expanded into a low pressure gas which is then sent toward the condenser 1.

Figure 6:
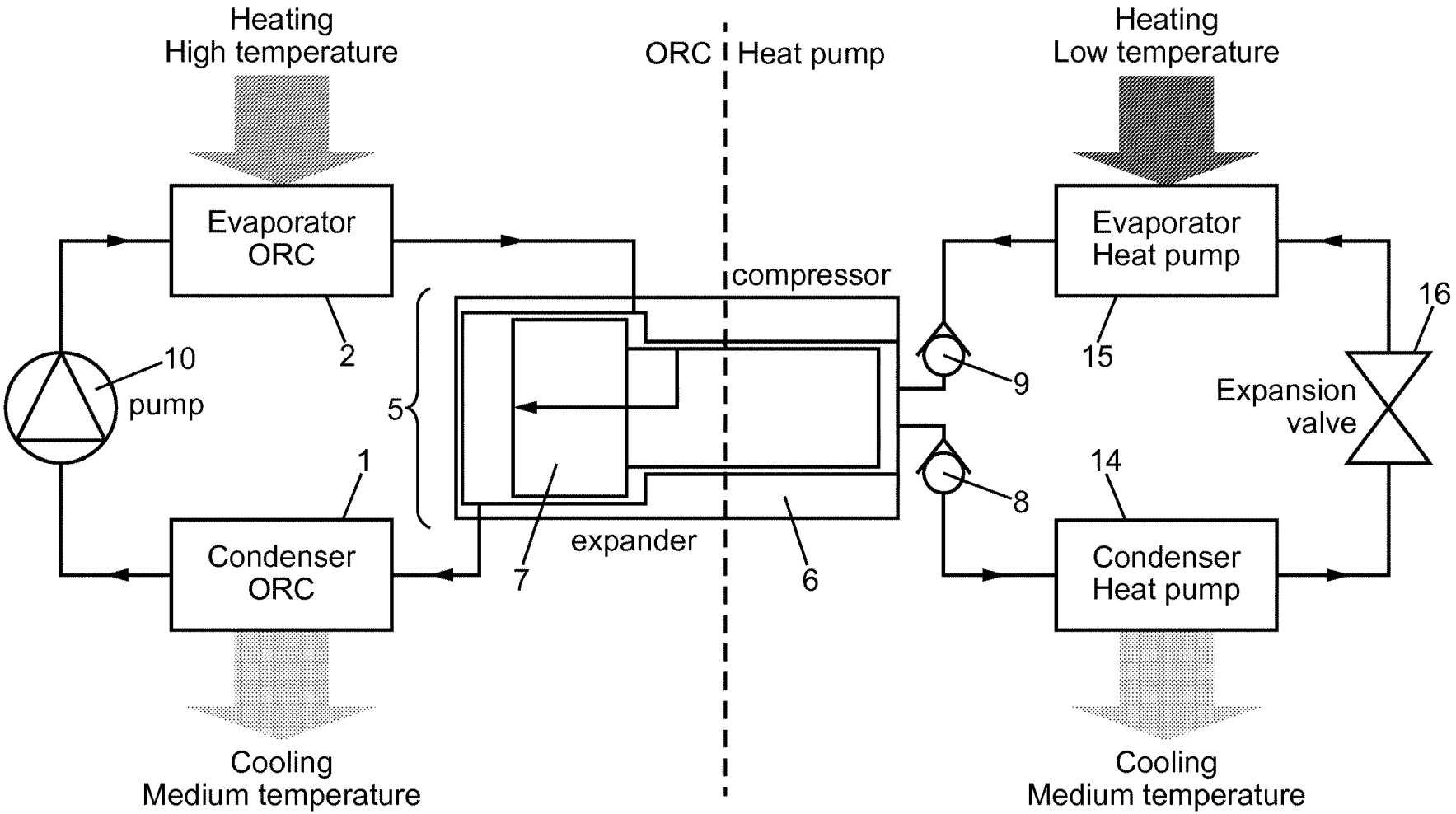
FIG. 6 shows another example of an application to an organic Rankine cycle or to a Rankine cycle for the energy powering stage of the free piston expander and to a heat pump for the energy providing stage of the free piston expander, of a thermodynamic cycle process according to an embodiment of the invention, with the free piston expander powering a compressor, with separate condensers for both stages.

FIG. 6 shows another example of an application to an organic Rankine cycle or to a Rankine cycle for the energy powering stage of the free piston expander and to a heat pump for the energy providing stage of the free piston expander, of a thermodynamic cycle process according to an embodiment of the invention, with the free piston expander powering a compressor, with separate condensers for both stages.

The main thermodynamic machine comprises a condenser 1 connected to both a pump 10 and a free piston expander 5 including a free piston 7 sliding in a sliding chamber 6. The condenser 1 is connected to the free piston expander 5 energy powering stage directly.

The main thermodynamic machine comprises an evaporator 2 connected to both the pump 10 and the free piston expander 5. The evaporator 2 is connected to the free piston expander 5 energy powering stage directly.

The pump 10 pumps a liquid coming from condenser 1 and sends this liquid toward the evaporator 2. An external source of energy, not represented, is powering the pump 10. The free piston expander 5 provides energy toward an auxiliary thermodynamic machine. Heat, at high temperature, coming for example from waste heat recovery or from solar heating or from biomass combustion, is brought to the evaporator 2. The condenser 1 provides cooling at medium temperature.

The condenser 1 changes the gas coming from the free piston expander 5 into liquid and sends the liquid toward the pump 10. The pump 10 sends the liquid toward the evaporator 2 which changes the liquid into gas. The free piston expander 5 energy powering stage receives gas at high pressure coming from the evaporator 2, and sends gas at low pressure toward the condenser 1, gas being expanded when going through the free piston expander 5 energy powering stage.

The auxiliary thermodynamic machine comprises a condenser 14 providing cooling at medium temperature to outside and an evaporator 15 receiving heating at low temperature from outside.

The evaporator 15 is connected to both an expansion valve 16 and the free piston expander 5 energy providing stage via a low pressure valve 9. The condenser 14 is connected to both the expansion valve 16 and the free piston expander 5 energy providing stage via a high pressure valve 8.

The free piston expander 5 energy providing stage compresses gas at low pressure coming from the evaporator 15 via low pressure valve 9, and sends it at high pressure toward the condenser 14 via high pressure valve 8.

The condenser 14 changes the gas coming from free piston expander 5 energy providing stage via high pressure valve 8 into liquid and sends the liquid toward the expansion valve 16 where it is expanded. The evaporator 15 changes the liquid coming from the expansion valve 16 into gas and then sends the gas at low pressure toward the free piston expander 5 energy providing stage where this low pressure gas is compressed into a high pressure gas.

Figure 7:
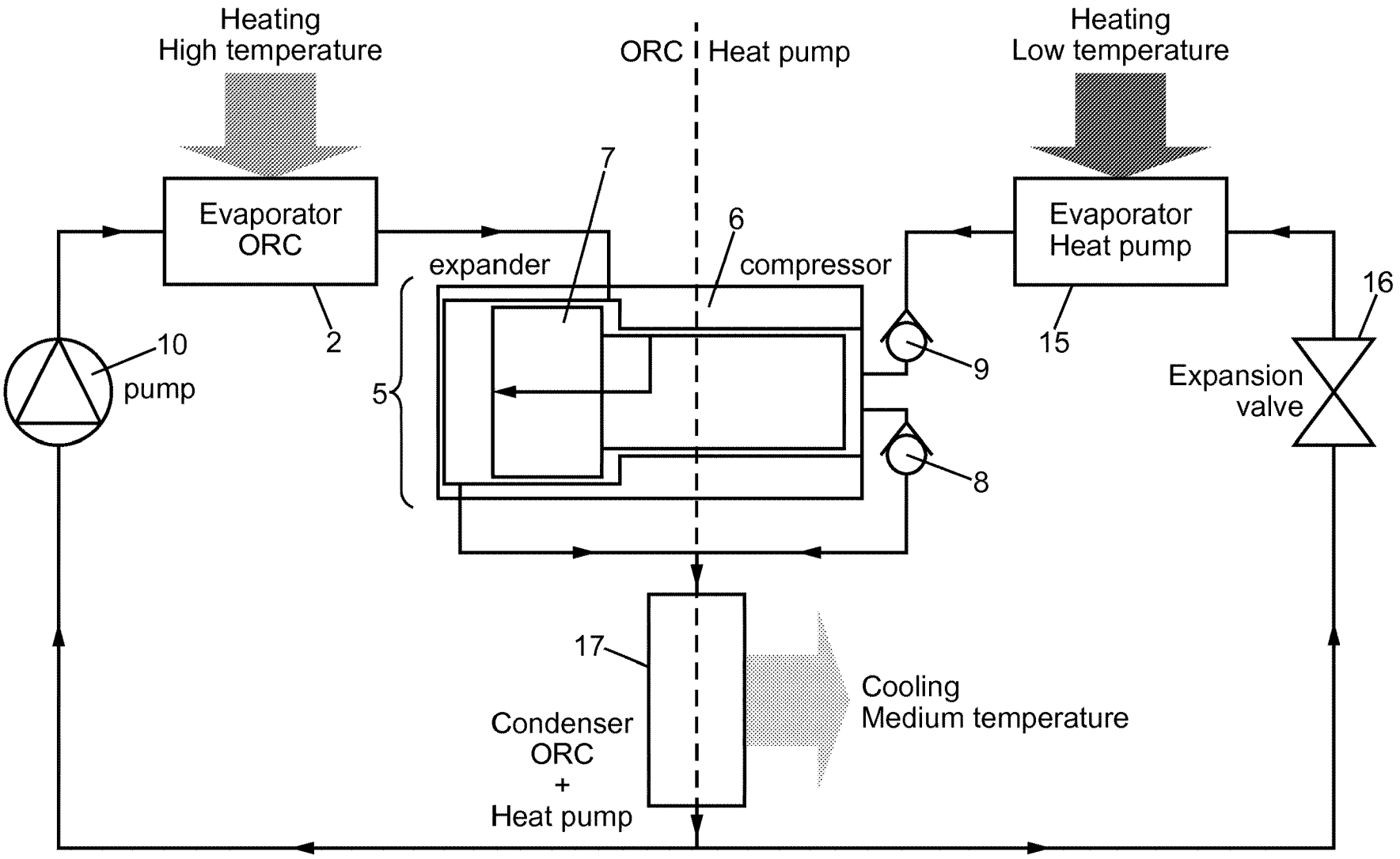
FIG. 7 shows another example of an application to an organic Rankine cycle or to a Rankine cycle for the energy powering stage of the free piston expander and to a heat pump for the energy providing stage of the free piston expander, of a thermodynamic cycle process according to an embodiment of the invention, with the free piston expander powering a compressor, with a common condenser for both stages.

FIG. 7 shows another example of an application to an organic Rankine cycle or to a Rankine cycle for the energy powering stage of the free piston expander and to a heat pump for the energy providing stage of the free piston expander, of a thermodynamic cycle process according to an embodiment of the invention, with the free piston expander powering a compressor, with a common condenser for both stages.

The main thermodynamic machine and the auxiliary thermodynamic machine are similar to the ones shown on FIG. 6, except that they share a common condenser 17. This common condenser 17 receives gas coming from both energy powering stage and energy providing stage of free piston expander 5, via high pressure valve 8 from free piston expander 5 providing stage. This common condenser 17 changes gas into liquid and sends the liquid toward both the pump 10 of the main thermodynamic machine and the expansion valve 16 of the auxiliary thermodynamic machine.

On FIGS. 8, 9, 10, 12, 14 and 16, there are represented two sliding directions for the free piston, which are a first direction D1 and a second direction D2. Second direction D2 is from chamber bottom 66 toward free space 65. First direction D1 is from free space 65 toward chamber bottom 66.

Figure 8:
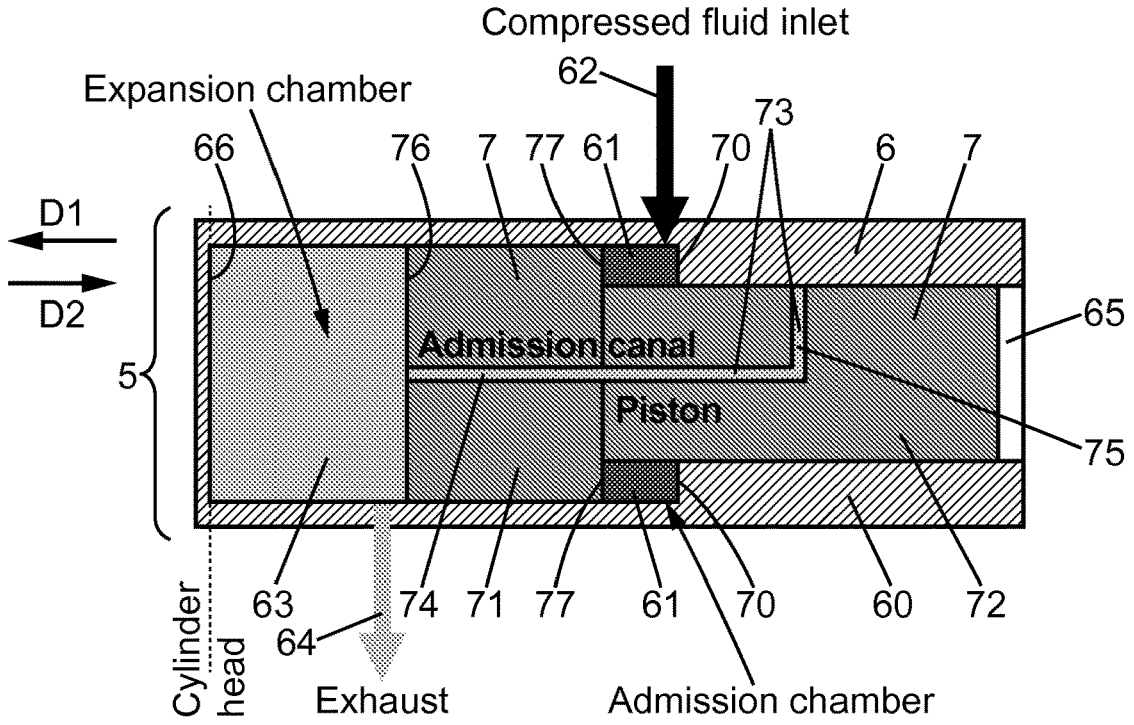
FIG. 8 shows an example of a structure of a free piston expander, of a thermodynamic cycle process according to an embodiment of the invention.

FIG. 8 shows an example of a structure of a free piston expander, of a thermodynamic cycle process according to an embodiment of the invention.

The free piston expander 5 comprises a free piston 7 sliding, alternatively first in a first sliding direction then in a second direction opposed to the first direction, in a sliding chamber 6. There is an admission inlet 62 receiving compressed gas from thermodynamic cycle machine main circuit (including evaporator and condenser represented on FIGS. 1 to 7) and an exhaust outlet 64 sending expanded gas toward thermodynamic cycle machine main circuit (including evaporator and condenser represented on FIGS. 1 to 7).

Free piston 7 comprises a cylindrical body including a cylindrical piston head 71 and a cylindrical piston rod 72 with an annular piston shoulder 77 for the surface of cylindrical piston head 71 extending over cylindrical piston rod 72 at the level of the junction between cylindrical piston head 71 and cylindrical piston rod 72. At the level of free extremity of piston head 71, there is a circular piston head surface 76 which is notably larger than the annular piston shoulder surface 77. Within the body of the free piston 7, there is an admission canal 73 including on the one hand an axial canal 74 extending over the whole length of the piston head 71 and extending over part of the axial length of the piston rod 72, and on the other hand a radial canal 75 extending over part of the radial width of the piston rod 72. Preferably, the axial canal 74 extends axially along the axis of symmetry of the free piston 7 body, the whole free piston body 7 being thereby better balanced. Preferably, the radial canal 75 extends radially from axis of symmetry of the piston rod 72 body until periphery of the piston rod 72.

Sliding chamber 6 is cylindrical and has a cylindrical chamber wall 60 with two different internal diameters separated by a chamber shoulder 70, so that piston head 71 slides on one side of this chamber shoulder 70 against chamber wall 60 and piston rod 72 slides on the other side of this chamber shoulder 70 against chamber wall 60. There is an annular admission chamber 61 located between piston shoulder 77 and chamber shoulder 70 as well as between chamber wall 60 and piston rod 72 periphery. This admission chamber 61 receives compressed gas from admission inlet 62. At closed axial extremity of sliding chamber 6, on the side of piston head 71, there is a chamber bottom 66 of the sliding chamber 6. There is a cylindrical expansion chamber 63 located between chamber bottom 66 and piston head surface 76 as well as inside cylindrical chamber wall 60. This expansion chamber 63 sends expanded gas toward exhaust outlet 64. At open axial extremity of sliding chamber 6, on the side of piston rod 72, there is a free space 65 which may contain a gas to be compressed or a fluid to be pumped by the free extremity of piston rod 72. All canals 73, 74 and 75 are channels allowing fluidic communication through them.

Variable volume of expansion chamber 63 decreases when variable volume of admission chamber 61 increases, and variable volume of expansion chamber 63 increases when variable volume of admission chamber 61 decreases.

Only one admission channel 73 has been represented on FIG. 8, what corresponds to a preferred embodiment; nevertheless the fluidic communication may also include more than one communicating channel located within the body of free piston 5 or even outside the body of free piston 5, for instance within the chamber wall 60.

The axial admission canal 74 length is more than 70% of the full length of the admission canal 73. The radial admission canal 75 length is less than 30% of the full length of the admission canal 73.

The ratio between annular piston shoulder surface 77 and circular piston head surface 76 is less than 70%.

In the step of powering a liquid pump or a gas compressor with retrieved energy from fluid expansion, free piston expander 5 alternatively changes direction of free piston 7 sliding: by alternatively: opening an admission canal 73 between both opposite sides of free piston 7, so as to make equal to each other the pressures applied respectively thereon, so that free piston 7 slides and accelerates in second sliding direction from chamber bottom 66 toward free space 65, closing admission canal 73 between both opposite sides of free piston 7, so as to make different from each other the pressures applied respectively thereon, so that free piston 7 slides and accelerates in first direction opposite to said second direction, i.e. from free space 65 toward chamber bottom 66, this free piston 7 sliding and accelerating, directly and mechanically, opening and closing, admission canal 73. This will be explained in more details with respect to FIGS. 10, 12, 14 and 16.

Free piston expander 5, which is located between a compressed fluid flow and an expanded fluid flow of the thermodynamic cycle process, has all of its pieces which are static except only one piece, free piston 7 body (including free piston head 71 and free piston rod 72 which move jointly as a single piece and which are advantageously made together of one single piece) which is moving, that is the free piston 7 which slides within the static sliding chamber 6.

Figure 9:
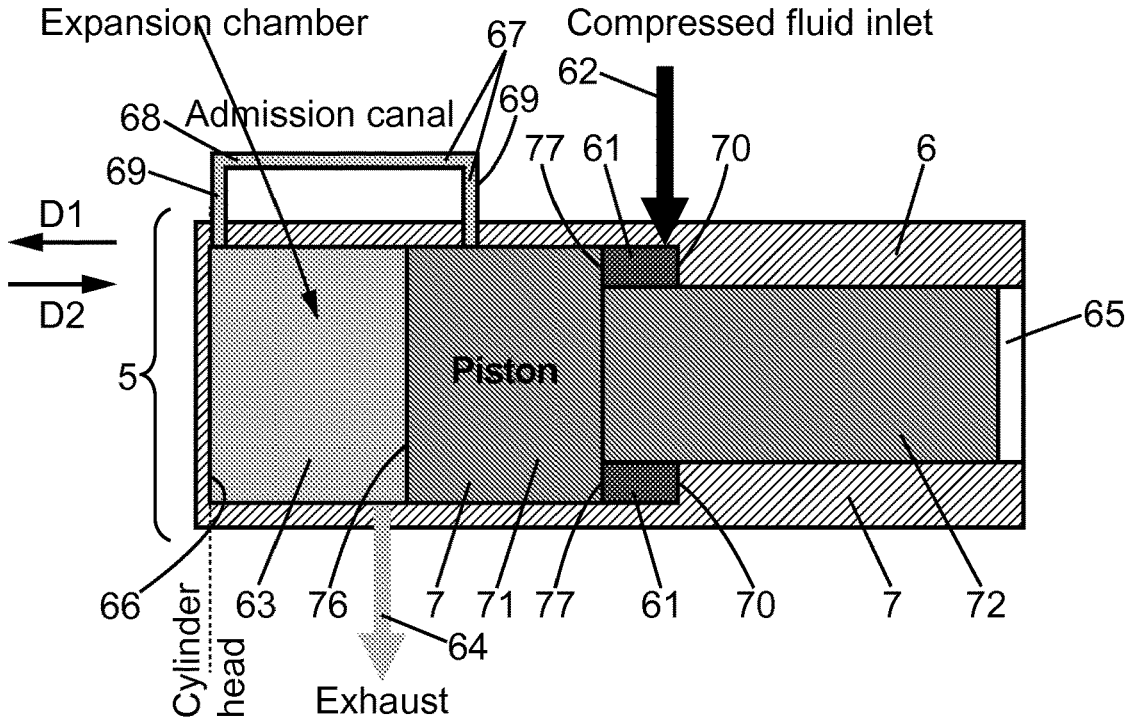
FIG. 9 shows another example of a structure of a free piston expander, of a thermodynamic cycle process according to an embodiment of the invention.

FIG. 9 shows another example of a structure of a free piston expander, of a thermodynamic cycle process according to an embodiment of the invention.

The free piston expander 5 of FIG. 9 is similar to the free piston expander 5 of FIG. 8, except for the admission canal 73 located within the body of free piston 7 which is replaced by an admission canal 67 located within the chamber wall 60.

Within the chamber wall 60, there is an admission canal 67 including on the one hand an axial canal 68 extending axially partly over the length of the chamber wall 60 over part only of the chamber wall 60 located between chamber bottom 66 and chamber shoulder 70, and on the other hand two radial canals 69 extending radially outward from chamber wall 60. The axial canal 68 is located between both radial canals 69.

Only one admission channel 67 has been represented on FIG. 9, what corresponds to a preferred embodiment; nevertheless the fluidic communication may also include more than one communicating channel located within the chamber wall 60.

Axial admission canal 68 length is more than 55% of full length of admission canal 67. The sum of lengths of radial admission canals 69 is less than 45% of full length of admission canal 67.

Figure 10:
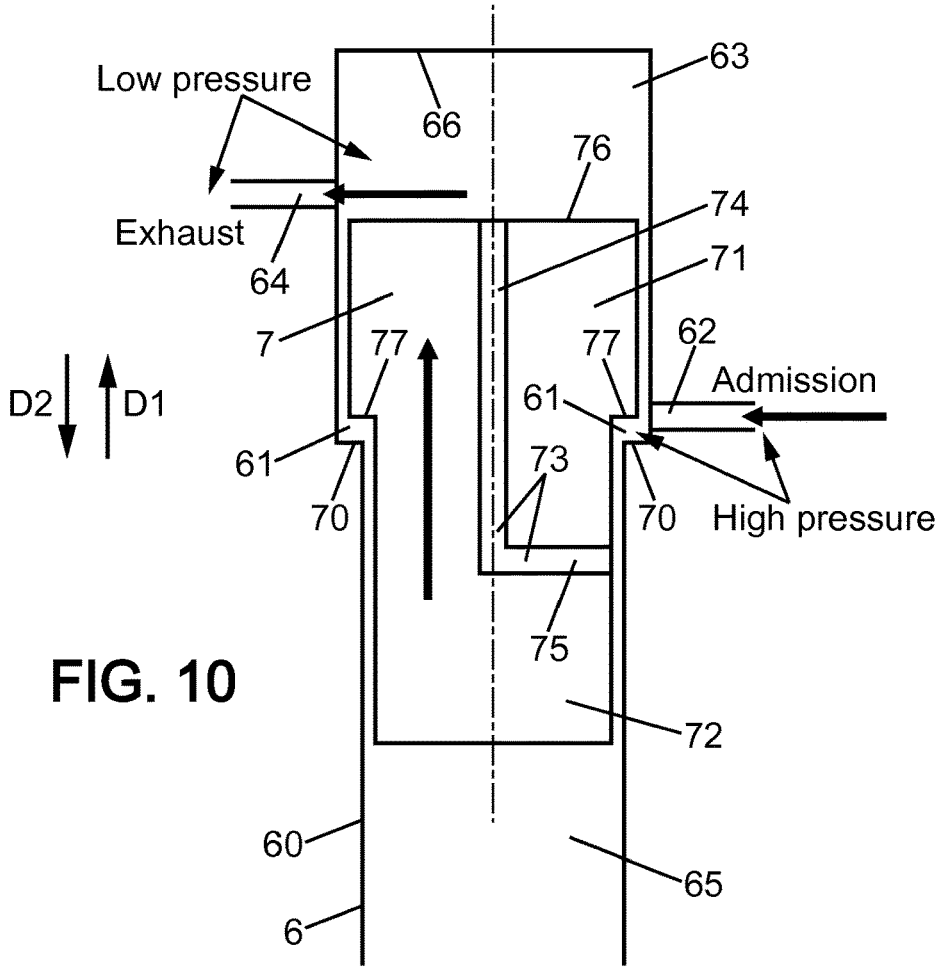
FIG. 10 shows an example of a first phase of operation of the free piston expander, according to an embodiment of the invention.

FIG. 10 shows an example of a first phase of operation of the free piston expander, according to an embodiment of the invention.

Compressed gas arrives into admission chamber 61 from admission inlet 62. This compressed gas increases the variable volume of admission chamber 61 by moving piston shoulder 77 apart from chamber shoulder 70, thereby making free piston 7 sliding within sliding chamber 6 in a first direction from free space 65 to chamber bottom 66, thereby reducing the variable volume of expansion chamber 63, thereby pushing away gas from expansion chamber 63 toward exhaust outlet 64. There is a fluidic communication between admission inlet 62 and admission chamber 61, since admission inlet 62 opens into admission chamber 61. There is no fluidic communication between admission canal 73 and admission chamber 61, since free extremity of radial canal 75 is closed by chamber wall 60. There is a fluidic communication between admission canal 73 and expansion chamber 63, since free extremity of axial channel 74 opens into expansion chamber 63. There is a fluidic communication between exhaust outlet 64 and expansion chamber 63, since exhaust outlet 64 opens into expansion chamber 63.

Figure 11:
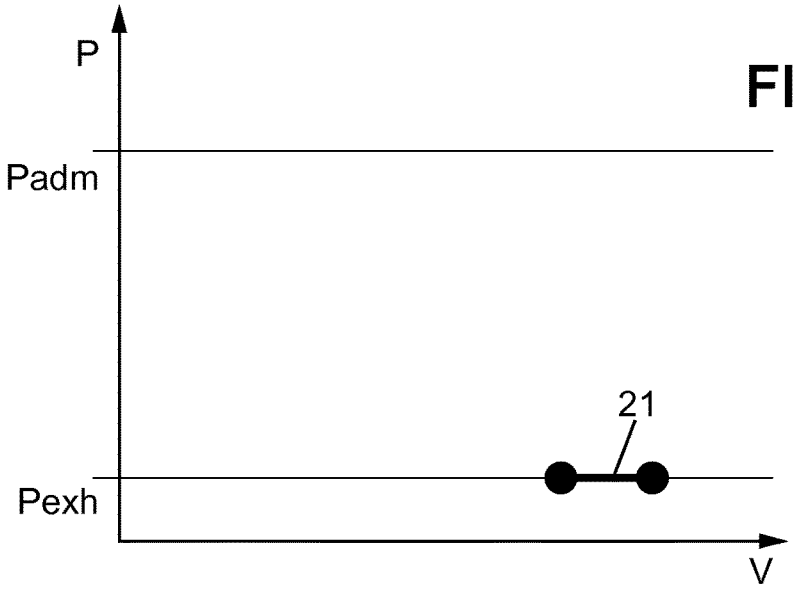
FIG. 11 shows an example of a corresponding first phase in a diagram pressure volume in the expansion chamber of the free piston expander, according to an embodiment of the invention.

FIG. 11 shows an example of a corresponding first phase in a diagram pressure volume in the expansion chamber of the free piston expander, according to an embodiment of the invention.

Within the variable volume of expansion chamber 63, gas pressure remains at a low level Pexh since free piston 7 moving simply makes gas contained within expansion chamber 63 exhaust out of expansion chamber 63 as free piston 7 moves along first sliding direction toward chamber bottom 66. This volume reduction at constant pressure is noted thermodynamic phase 21.

Figure 12:
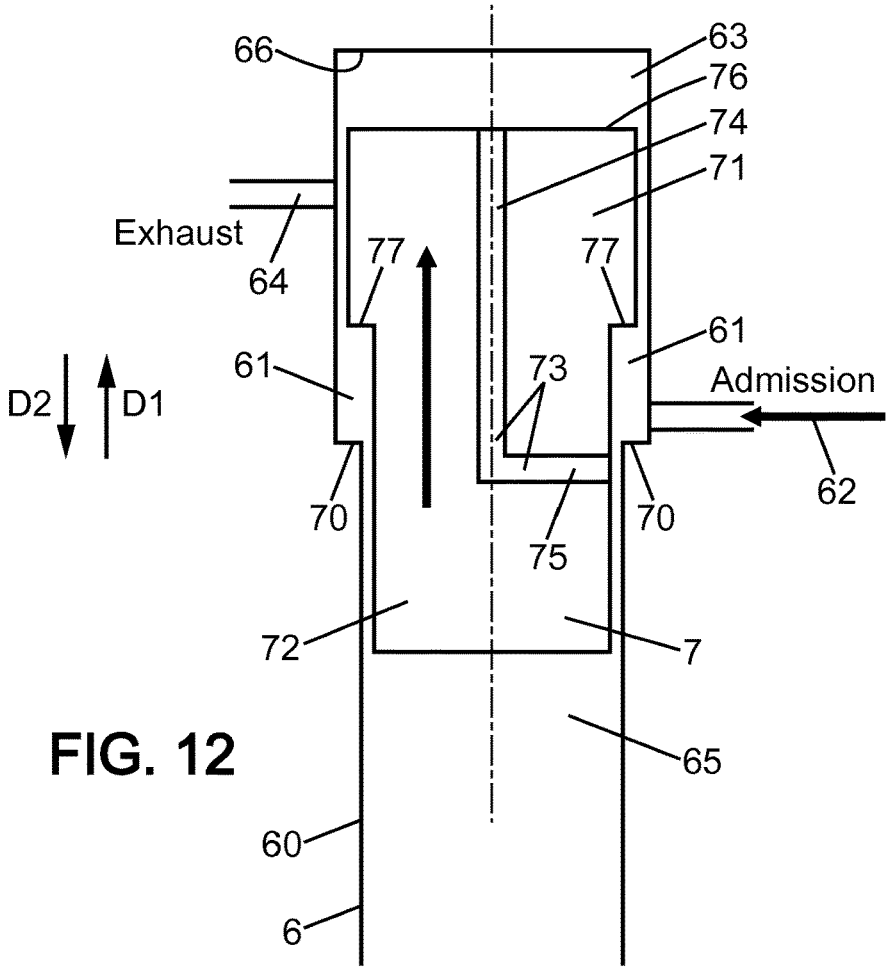
FIG. 12 shows an example of a second phase of operation of the free piston expander, according to an embodiment of the invention.

FIG. 12 shows an example of a second phase of operation of the free piston expander, according to an embodiment of the invention.

Compressed gas continues to arrive into admission chamber 61 from admission inlet 62. This compressed gas continues to increase the variable volume of admission chamber 61 by moving piston shoulder 77 further apart from chamber shoulder 70, thereby making free piston 7 continuing and sliding within sliding chamber 6 in first direction from free space 65 to chamber bottom 66, thereby further reducing the variable volume of expansion chamber 63, thereby compressing gas within expansion chamber 63 once exhaust outlet 64 has been closed by periphery of sliding piston head 71. There is a fluidic communication between admission inlet 62 and admission chamber 61, since admission inlet 62 opens into admission chamber 61. There is no fluidic communication between admission canal 73 and admission chamber 61, since free extremity of radial canal 75 is closed by chamber wall 60. There is a fluidic communication between admission canal 73 and expansion chamber 63, since free extremity of axial channel 74 opens into expansion chamber 63. There is no more fluidic communication between exhaust outlet 64 and expansion chamber 63, since exhaust outlet 64 is now closed by sliding piston head 71.

Figure 13:
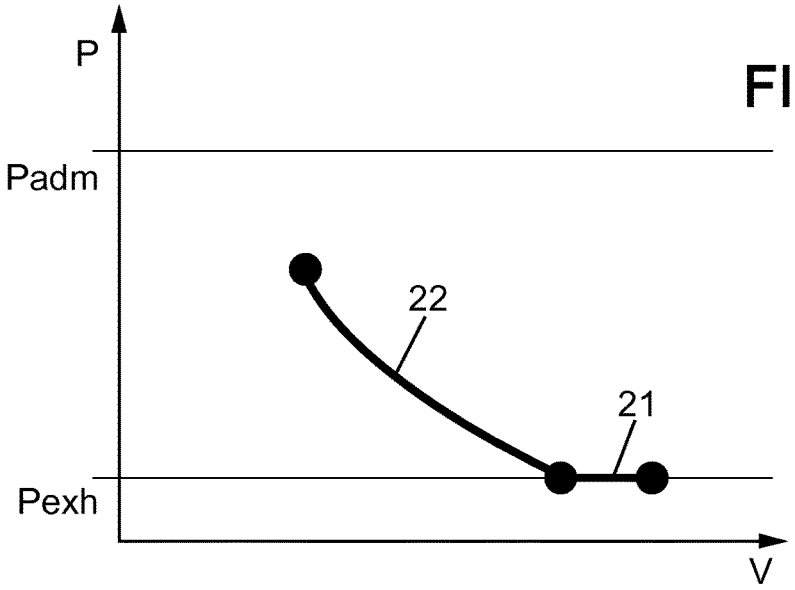
FIG. 13 shows an example of a corresponding second phase in a diagram pressure volume in the expansion chamber of the free piston expander, according to an embodiment of the invention.

FIG. 13 shows an example of a corresponding second phase in a diagram pressure volume in the expansion chamber of the free piston expander, according to an embodiment of the invention.

Within the variable volume of expansion chamber 63, gas pressure increases from low level Pexh toward high level Padm (high pressure in admission chamber 61) since free piston 7 moving now compresses gas contained within expansion chamber 63 which cannot anymore exhaust out of expansion chamber 63 as free piston 7 moves along first sliding direction toward chamber bottom 66. This volume reduction with pressure increase is noted thermodynamic phase 22.

Figure 14:
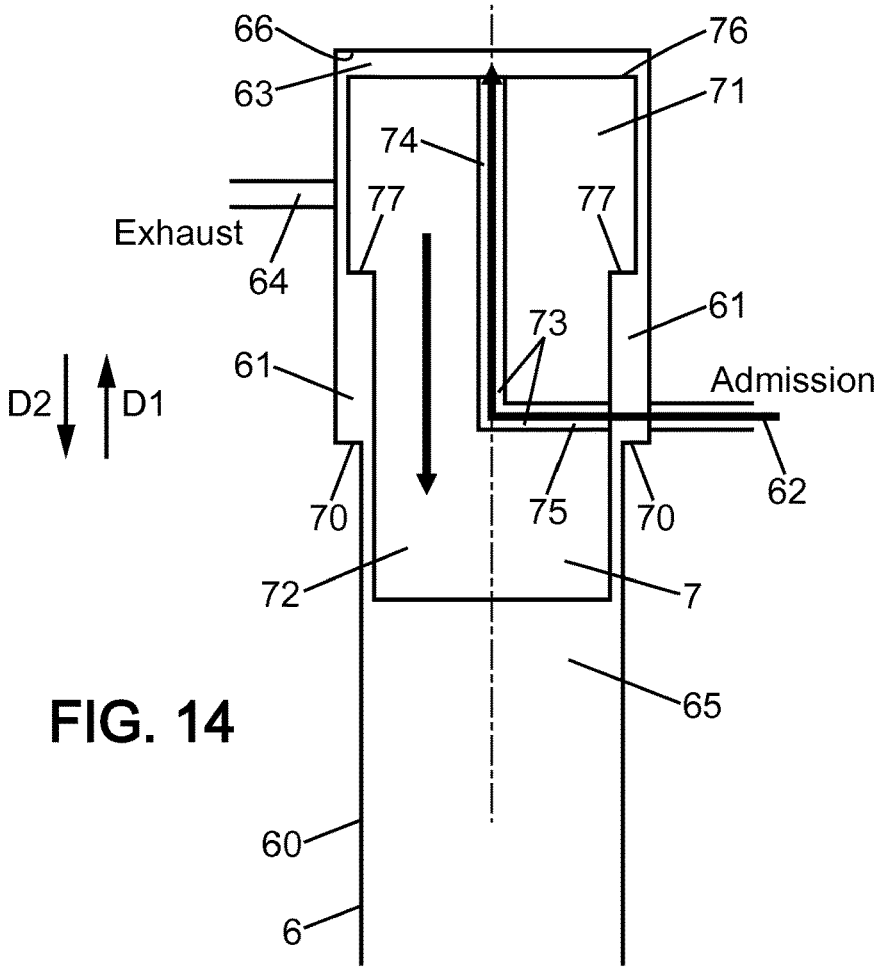
FIG. 14 shows an example of a third phase of operation of the free piston expander, according to an embodiment of the invention.

FIG. 14 shows an example of a third phase of operation of the free piston expander, according to an embodiment of the invention.

Compressed gas continues to arrive into admission chamber 61 from admission inlet 62. This compressed gas continues to increase the variable volume of admission chamber 61 by moving piston shoulder 77 further apart from chamber shoulder 70, thereby making free piston 7 continuing and sliding within sliding chamber 6 in first direction from free space 65 to chamber bottom 66, thereby further reducing the variable volume of expansion chamber 63, thereby compressing gas within expansion chamber 63 since exhaust outlet 64 has been closed by periphery of sliding piston head 71, until admission canal 73 opens into admission chamber 61 by free end of radial canal 75 opening into admission chamber 61. Then, there is a pressure balancing between admission chamber 61 and expansion chamber 63 by pressure equalizing through admission canal 73. There is a fluidic communication between admission inlet 62 and admission chamber 61, since admission inlet 62 opens into admission chamber 61. There is now fluidic communication between admission canal 73 and admission chamber 61, since free end of radial canal 75 opens into admission chamber 61. There is a fluidic communication between admission canal 73 and expansion chamber 63, since free end of axial channel 74 opens into expansion chamber 63. There is no more fluidic communication between exhaust outlet 64 and expansion chamber 63, since exhaust outlet 64 is now closed by sliding piston head 71.

Figure 15:
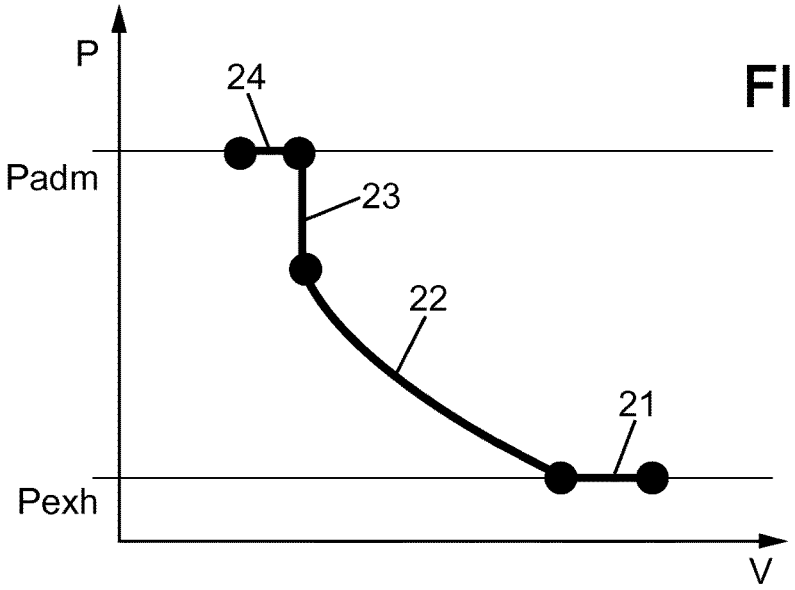
FIG. 15 shows an example of a corresponding third phase in a diagram pressure volume in the expansion chamber of the free piston expander, according to an embodiment of the invention.

FIG. 15 shows an example of a corresponding third phase in a diagram pressure volume in the expansion chamber of the free piston expander, according to an embodiment of the invention.

Within the variable volume of expansion chamber 63, after establishing of a fluidic communication between admission chamber 61 and expansion chamber 63 through admission canal 73, there is a further brutal gas pressure increase until high level Padm (high pressure in admission chamber 61) because of the pressure equalizing between admission chamber 61 and expansion chamber 63. This volume reduction with pressure increase is noted thermodynamic phase 23. Afterwards, there is still a volume reduction at constant pressure which is noted thermodynamic phase 24 and which comes from the inertia of the free piston 7 body which does not instantly stop its travel, but which curtails progressively before inverting its move toward second sliding direction opposed to first sliding direction, moving then away from chamber wall 66 toward free space 65 during next phase of operation described in FIGS. 16 and 17.

Figure 16:
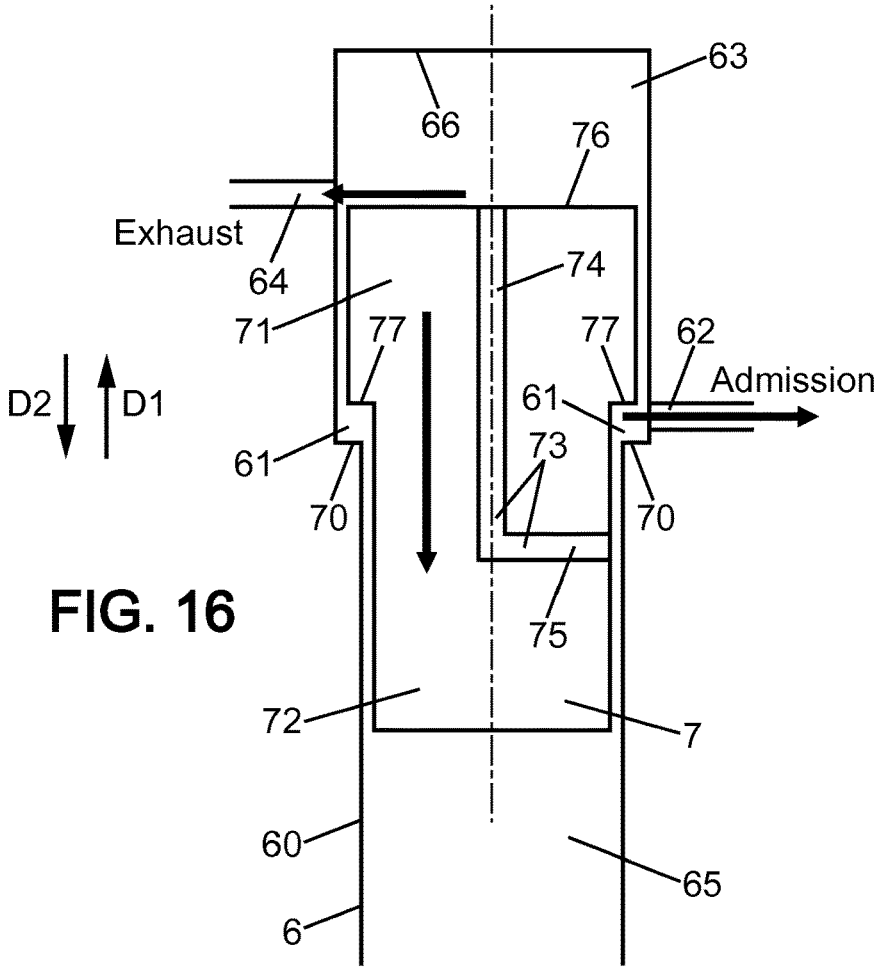
FIG. 16 shows an example of a fourth phase of operation of the free piston expander, according to an embodiment of the invention.

FIG. 16 shows an example of a fourth phase of operation of the free piston expander, according to an embodiment of the invention.

Compressed gas starts being expelled from admission chamber 61 toward admission inlet 62, until piston head 71 periphery stops closing exhaust outlet 64 and piston head surface 76 goes past exhaust outlet 64 to let again exhaust outlet 64 opening into expansion chamber 63, because there are the same pressures within admission chamber 61 and expansion chamber 63 whereas the piston head surface 76 on which this common pressure applies is notably more important, at least by a factor 1.5, preferably by at least a factor 2, more preferably at least a factor 3, than the piston shoulder surface 77 on which this same common pressure applies too since there is fluidic communication through admission canal 73 between admission chamber 61 and expansion chamber 63. Free piston 7 has inverted its move toward second sliding direction opposed to first sliding direction, moving thereby away from chamber wall 66 toward free space 65.

The variable volume of admission chamber 61 is reduced by moving piston shoulder 77 toward chamber shoulder 70, thereby making free piston 7 continuing and sliding within sliding chamber 6 in second direction from chamber bottom 66 toward free space 65, thereby increasing the variable volume of expansion chamber 63, thereby expanding gas within expansion chamber 63 until piston head surface 76 reaches and goes past exhaust outlet 64 making then this exhaust outlet 64 opening again into expansion chamber 63. At beginning of free piston 7 sliding in second sliding direction, fluidic communication between admission canal 73 and admission chamber 61 rapidly becomes closed since free end of radial canal 75 becomes closed by chamber wall 60, and this happens before exhaust outlet 64 again opens into expansion chamber 63. Then, there is no more pressure balancing between admission chamber 61 and expansion chamber 63.

There is a fluidic communication between admission inlet 62 and admission chamber 61, since admission inlet 62 opens into admission chamber 61. There is no more fluidic communication between admission canal 73 and admission chamber 61, since free end of radial canal 75 is now closed by chamber wall 60. There is a fluidic communication between admission canal 73 and expansion chamber 63, since free end of axial channel 74 opens into expansion chamber 63. There is again fluidic communication between exhaust outlet 64 and expansion chamber 63, since exhaust outlet 64 again opens into expansion chamber 63.

Figure 17:
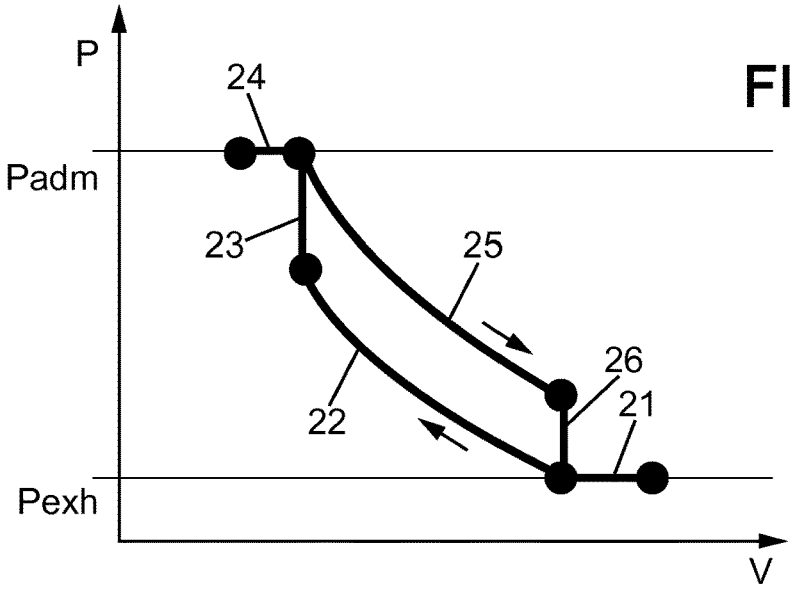
FIG. 17 shows an example of a corresponding fourth phase in a diagram pressure volume in the expansion chamber of the free piston expander, according to an embodiment of the invention.

FIG. 17 shows an example of a corresponding fourth phase in a diagram pressure volume in the expansion chamber of the free piston expander, according to an embodiment of the invention.

Within the variable volume of expansion chamber 63, after inverting sliding direction of free piston 7 move, there is first a volume augmentation at constant high pressure Padm until admission canal 73 becomes closed again by chamber wall 60 closing free end of radial canal 75 (again noted thermodynamic phase 24 but from right to left on FIG. 17, whereas it was from right to left on FIG. 15), then there is a gas pressure progressive decrease because of gas expansion within increasing variable volume of expansion chamber 63, then followed by a further brutal gas pressure decrease (with constant volume) until low level Pexh (low pressure in expansion chamber 63) because of the pressure drop caused by the again opening of exhaust outlet 64 into expansion chamber 63 thereby rapidly expelling gas outside expansion chamber 63. This volume reduction with pressure decrease is noted thermodynamic phase 25, and is followed by the brutal drop pressure at constant volume which is noted thermodynamic phase 26. Then, there is a volume increase at constant low pressure Pexh noted thermodynamic phase 21 (from left to right on FIG. 17, whereas it was from right to left in FIG. 11).

Free piston 7 sliding has an oscillation frequency, and free piston 7 has a mass which has a value such that this oscillation frequency ranges from 20 Hz to 150 Hz, preferably ranges from 30 Hz to 120 Hz, more preferably ranges from 50 Hz to 90 Hz.

Figure 18:
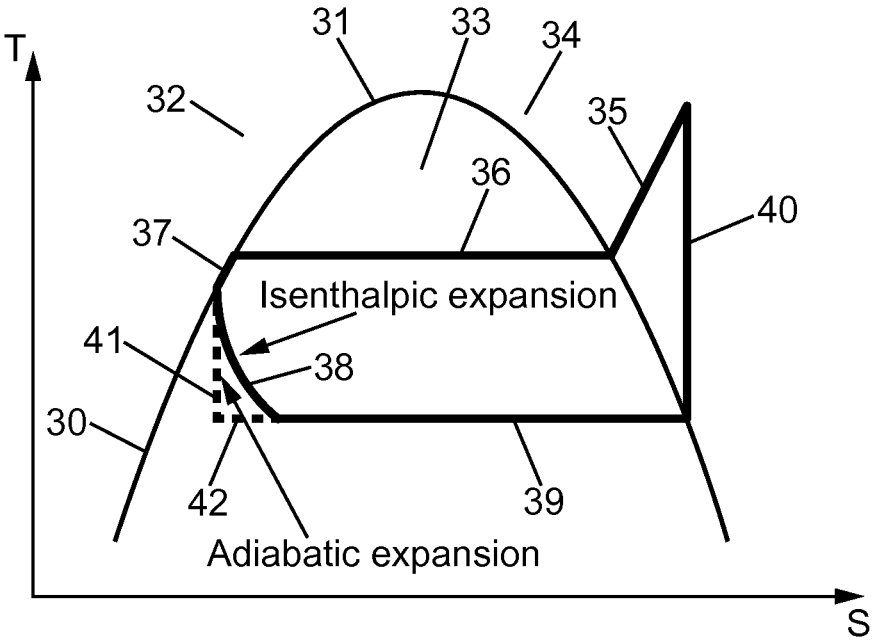
FIG. 18 shows an example of diagram of a thermodynamic cycle process, according to an embodiment of the invention.

FIG. 18 shows an example of diagram of a thermodynamic cycle process, according to an embodiment of the invention.

The fluid may be chosen among: water, or carbon dioxide, or air, or natural gas, or organic fluid. The thermodynamic cycle includes a phase of adiabatic expansion. This adiabatic expansion phase is more than a half of the whole expansion phase in length on the diagram of FIG. 18. At the beginning of this adiabatic expansion phase, the fluid may be: in a liquid state, or in a mixed state including both liquid and vapor, or in a super-critical fluid state.

Diagram of FIG. 18 corresponds to thermodynamic cycle of FIG. 2 (or even FIG. 3) and shows temperature T as a function of entropy S. There is a curve 30 limiting different regions corresponding to different states of the fluid used in the thermodynamic cycle. Point 31 is the point of critical temperature and of critical pressure. In region 32, fluid is in liquid state. In region 33, fluid is in a mix of liquid state and gas state. In region 34, fluid is in gas state. Above critical point 31, in an intermediate region between regions 32 and 34, fluid is in a supercritical state.

All segments of cycle will now be described, the cycle being performed anticlockwise. At beginning of segment 35, fluid is at output of compressor and at input of condenser. At end of segment 37, fluid is at output of condenser. At beginning of segment 39, fluid is at input of evaporator. At end of segment 39, fluid is at output of evaporator and at input of compressor.

Within condenser, first there is segment 35, where fluid remains at gas state and its temperature and entropy both decrease, then there is segment 36 where progressively fluid changes from gas state to a mix of gas state and liquid state to liquid state and its entropy decreases at constant temperature, at last segment 37, where fluid remains in liquid state and both its temperature and entropy decrease.

Within thermodynamic cycle, there is an expansion phase, represented by segment 38, which is an isenthalpic expansion phase in an optional non-preferred embodiment, where fluid temperature decreases and fluid entropy increases, while fluid state progressively changes from liquid state to a mix of liquid state and gas state.

Instead of this isenthalpic expansion phase 38, there could be two phases, a first phase 41 of adiabatic expansion (still within free piston expander) followed by a second phase 42 of isothermal evaporation (within evaporator), in a preferred embodiment. Instead, there could be another less preferred embodiment, where there are successively, a first phase 41 of adiabatic expansion followed by a second phase 38 of isenthalpic expansion (both within free piston expander) and then followed by a third phase 42 of isothermal evaporation (within evaporator), where it is preferred that length of adiabatic expansion 41 is more than length of isenthalpic expansion 38.

Within evaporator, there is segment 39, where fluid entropy increases at constant temperature, while fluid state progressively changes from a mix of liquid state and gas state to gas state.

Within compressor, there is segment 40, where fluid remains in gas state and is compressed at constant entropy.

Figure 19:
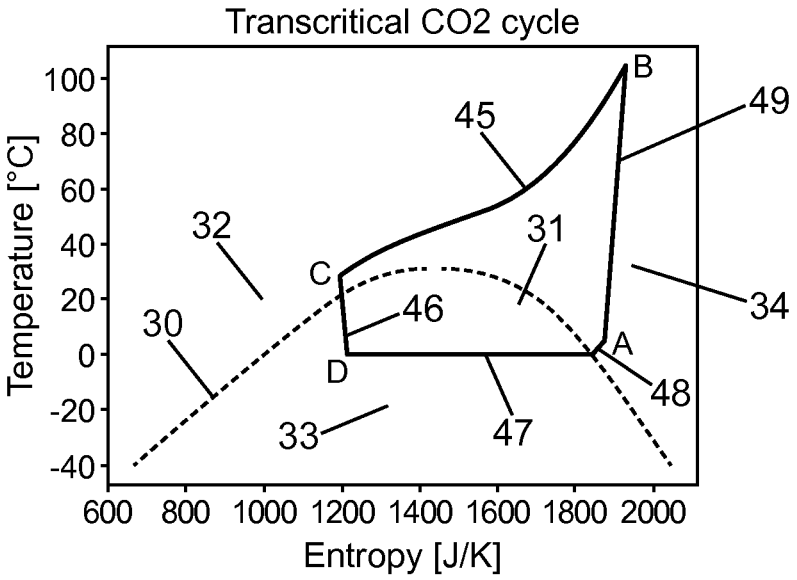
FIG. 19 shows another example of diagram of a thermodynamic cycle process, according to an embodiment of the invention.

FIG. 19 shows another example of diagram of a thermodynamic cycle process, according to an embodiment of the invention.

The fluid may be chosen as being carbon dioxide. At the beginning of the adiabatic expansion phase, the fluid is in a super-critical fluid state.

Diagram of FIG. 19 corresponds to thermodynamic cycle of FIG. 2 (or even FIG. 3) and shows temperature T as a function of entropy S. There is a curve 30 limiting different regions corresponding to different states of the fluid used in the thermodynamic cycle. Point 31 is the point of critical temperature and of critical pressure. In region 32, fluid is in liquid state. In region 33, fluid is in a mix of liquid state and gas state. In region 34, fluid is in gas state. Above critical point 31, in an intermediate region between regions 32 and 34, fluid is in a supercritical state.

All segments of cycle will now be described, the cycle being performed anticlockwise. At beginning of segment 45, fluid is at output of compressor and at input of condenser. At end of segment 45, fluid is at output of condenser. At beginning of segment 47, fluid is at input of evaporator. At end of segment 48, fluid is at output of evaporator and at input of compressor.

Within condenser, there is (curved) segment 45 going from point B to point C, where fluid goes from gas state toward liquid state via supercritical state, and its temperature and entropy both decrease.

Within free piston expander, there is an expansion phase, represented by segment 46, going from point C to point D, which is an adiabatic expansion phase, where fluid temperature decreases at constant entropy, while fluid state progressively changes from liquid state to a mix of liquid state and gas state.

Within evaporator, there is first segment 47 from point D, where fluid entropy increases at constant temperature, while fluid state progressively changes from a mix of liquid state and gas state to gas state, then followed by segment 48 until point A, where both temperature and entropy of fluid increase slightly while fluid remains at gas state.

Within compressor, there is segment 49 from point A to point B, where fluid remains in gas state and is compressed.

In FIG. 19, following conditions are set up:

Compression efficiency settled at 70%,

Expansion efficiency settled a 50%,

Super heating of 5° C. considered at input of compressor,

Evaporation temperature settled at 0° C.,

Temperature at output of condenser settled at 30° C.,

Condenser pressure varying between 73 bars and 120 bars.

Figure 20:
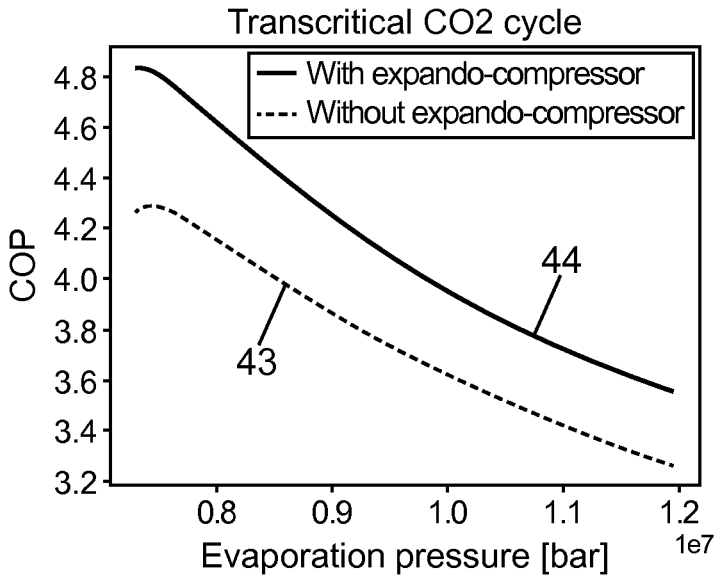
FIG. 20 shows an example of a performance gain improvement when using a free piston expander in a thermodynamic cycle process, according to an embodiment of the invention.

FIG. 20 shows an example of a performance gain improvement when using a free piston expander in a thermodynamic cycle process, according to an embodiment of the invention.

There is a curve 43 showing an example of a performance gain when using a free piston expander in a thermodynamic cycle process, under the conditions of FIG. 19, when using a simple expansion valve instead of a free piston expander (related to FIG. 2 with an expansion valve instead of the free piston expander).

There is a curve 44 showing an example of a performance gain when using a free piston expander in a thermodynamic cycle process, under the conditions of FIG. 19, when using a free piston expander instead of a simple expansion valve (with a thermodynamic machine as the one on FIG. 2).

The distance existing between curve 43 and curve 44 represents the performance gain improvement when using a free piston expander instead of a simple expansion valve. The horizontal axis represents the evaporation pressure expressed in bars. The vertical axis represents a performance coefficient (COP=coefficient of performance) expressed in a number without unity.

Figure 21:
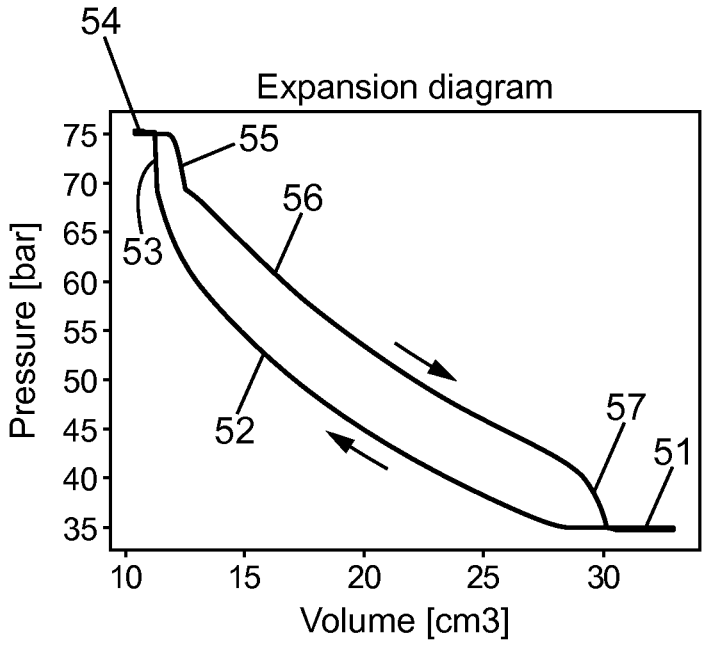
FIG. 21 shows an example of a diagram pressure volume in the expansion chamber of the free piston expander, according to an embodiment of the invention.

FIG. 21 shows an example of a diagram pressure volume in the expansion chamber of the free piston expander, according to an embodiment of the invention.

The horizontal axis represents the expansion volume expressed in $cm^3$. The vertical axis represents the expansion pressure expressed in bars. The diagram of FIG. 21 is performed clockwise. The different steps are performed successively:

Segment 51 from right to left: volume reduction at constant pressure, (curved) segment 52: compression (pressure increase with volume reduction), Segment 53: further pressure increase at constant volume, Segment 54 from right to left: volume reduction at constant pressure, Segment 54 from left to right: volume increase at constant pressure, Segment 55: pressure drop at constant volume, (curved) segment 56 and then practically vertical segment 57: expansion (pressure drop with volume increase), Segment 51 from left to right: volume increase at constant pressure.

Segments 51 and 54 lengths are related to the inertia caused by the non-negligible mass of the moving free piston.

Figure 22:
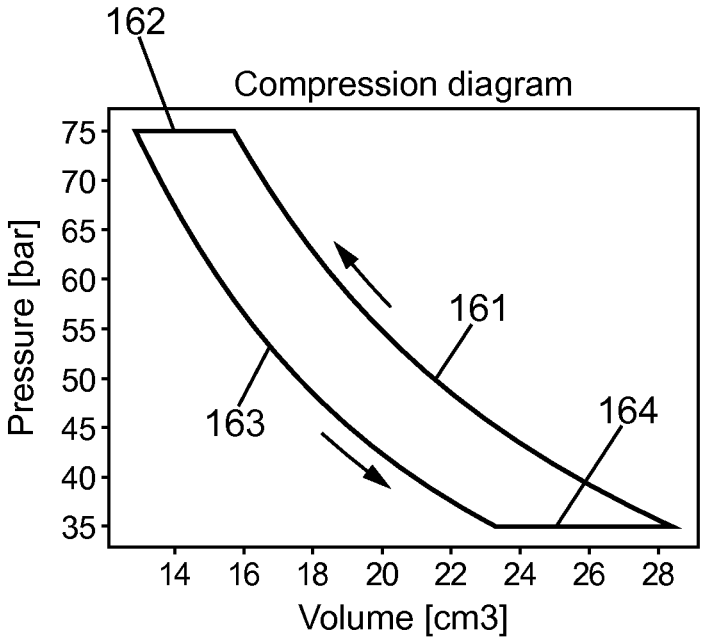
FIG. 22 shows an example of a diagram pressure volume in the compression cycle of the compressor, according to an embodiment of the invention.

FIG. 22 shows an example of a diagram pressure volume in the compression cycle of the compressor, according to an embodiment of the invention.

The horizontal axis represents the compression volume expressed in $cm^3$. The vertical axis represents the compression pressure expressed in bars. The diagram of FIG. 21 is performed anticlockwise. The different steps are performed successively:

(curved) segment 161: compression (pressure increase with volume reduction), Segment 162 from right to left: volume reduction at constant pressure, Segment 163: expansion (pressure drop with volume increase), Segment 164 from left to right: volume increase at constant pressure.

Figure 23:
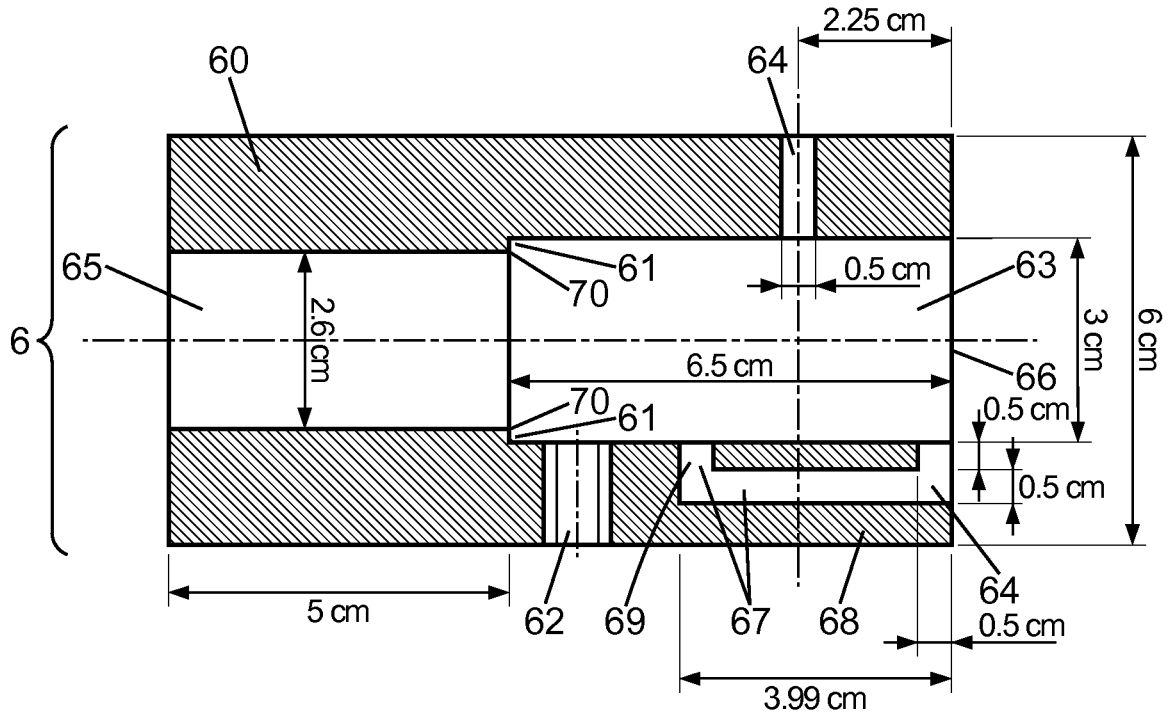
FIG. 23 shows an example of a detailed structure, with precise dimensions given in cm, of a free piston expander chamber, according to an embodiment of the invention, corresponding to FIG. 9.

FIG. 23 shows an example of a detailed structure, with precise dimensions given in cm, of a free piston expander chamber, according to an embodiment of the invention, corresponding to FIG. 9.

Axial admission canal 68 length value is 3.99 cm, length of each radial canal 79 value is 1 cm, admission canal 67 diameter value is 0.5 cm.

Diameter of sliding chamber has a value of 2.6 cm for receiving piston rod 72 (or slightly more to ensure smooth sliding), diameter of sliding chamber has a value of 3 cm for receiving piston head 71 (or slightly more to ensure smooth sliding). Diameter of admission inlet 62 has a value of 0.9 cm, diameter of exhaust outlet 64 has a value of 0.5 cm.

Length of sliding chamber has a value of 5 cm for receiving piston rod 72. Depth of expansion chamber 63, between middle of exhaust outlet 64 and chamber bottom 66, has a value of 2.25 cm.

Figure 24:
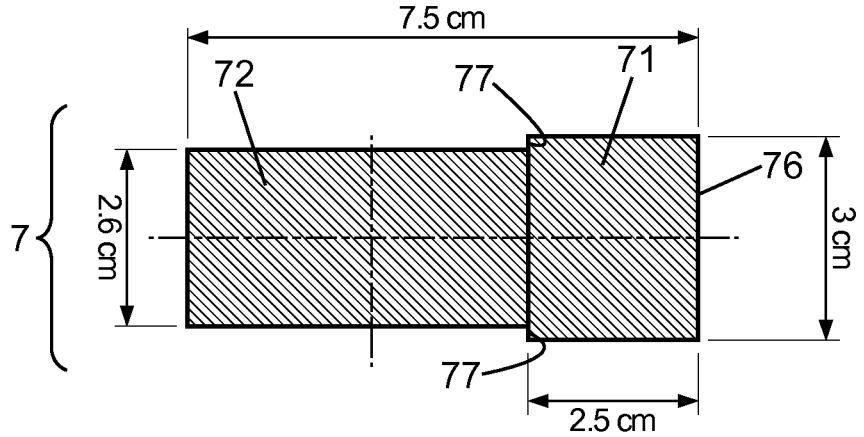
FIG. 24 shows an example of a detailed structure, with precise dimensions given in cm, of a free piston expander piston, according to an embodiment of the invention, corresponding to FIG. 9.

FIG. 24 shows an example of a detailed structure, with precise dimensions given in cm, of a free piston expander piston, according to an embodiment of the invention, corresponding to FIG. 9. For a free piston expander as on FIG. 8, all dimensions are the same except for axial admission canal 74 length which value is 4.8 cm, radial canal length 75 which value is 1.3 cm, admission canal 73 diameter which value is 0.5 cm.

Diameter of free piston head 71 has a value of 3 cm (or slightly less to ensure smooth sliding), diameter of free piston rod 72 has a value of 2.6 cm (or slightly less to ensure smooth sliding). Length of piston head 71 has a value of 2.5 cm, length of piston rod 72 has a value of 5 cm, full length of free piston 7 has a value of 7.5 cm.

Free piston body may be made of ceramics (alumina or zirconium oxide), graphite or aluminum, possibly with sliding guiding parts in ceramics or in graphite. For applications at rather low temperatures, this free piston body may be made of either Teflon (PTFE) or PEEK (polyetheretherketone). Chamber wall may be made of ceramics (alumina or zirconium oxide), stainless steel (inox 314 or inox 316), or spheroidal graphite cast iron.

The invention has been described with reference to preferred embodiments. However, many variations are possible within the scope of the invention.

The invention claimed is:

1. A thermodynamic cycle process, performing transfer between mechanical and heat energies, by changing a state of a fluid, the process comprising:

conducting an expansion of said fluid;

retrieving an energy from said fluid expansion; and powering a liquid pump or a gas compressor with said retrieved energy, using a cyclic free piston expander which alternatively changes direction of said free piston sliding by alternatively:

closing said fluidic communication between said both opposite sides of said free piston, to make the pressures applied respectively thereon different from each other, so that said free piston then slides in a first direction, opening a fluidic communication between both opposite sides of said free piston, to make the pressures applied respectively thereon equal to each other, so that said free piston then slides in a second direction opposite to said first direction, wherein said free piston is sliding, directly and mechanically, opening and closing, said fluidic communication, the free piston sliding within a sliding chamber, said first surface of said free piston is in an admission space of said sliding chamber having a first variable volume, and said second surface of said free piston is in an expansion space of said sliding chamber having a second variable volume, said second volume decreasing when said first volume increases and said second volume increasing when said first volume decreases.

2. The thermodynamic cycle process according to claim 1, wherein said fluidic communication includes one or more communicating channel located within the body of said free piston.

3. The thermodynamic cycle process according to claim 2, wherein said communicating channel is a bent channel, a major part of a length of the communicating channel extending axially with respect to said sliding directions of said free piston, a minor part of a length of the communicating channel extending radially with respect to said sliding directions of said free piston.

4. The thermodynamic cycle process according to claim 3, wherein:

an axial length end of said communicating channel opens into said expansion space, a radial length end of said communicating channel:

opens into said admission space at end of free piston sliding stroke when said free piston slides in said first direction, leads against sliding chamber wall during the major part of free piston sliding stroke from beginning when said free piston slides in said first direction, opens into said admission space at beginning of free piston sliding stroke when said free piston slides in said second direction, and leads against sliding chamber wall during the major part of free piston sliding stroke until end when said free piston slides in said second direction.

5. The thermodynamic cycle process according to claim 1, wherein:

said free piston slides within a sliding chamber, and said fluidic communication includes one or more communicating channel located within the wall of said sliding chamber.

6. The thermodynamic cycle process according to claim 5, wherein said communicating channel is a doubly bent channel, a major part of a length of the communicating channel extending axially with respect to said sliding directions of said free piston, a minor part of a length of the communicating channel extending radially with respect to said sliding directions of said free piston.

7. The thermodynamic cycle process according to claim 6, wherein:

an axial length of said communicating channel is located between two radial lengths of said communicating channel, an end of one radial length of said communicating channel:

opens into said expansion space at end of free piston sliding stroke in said first direction, and an end of the other radial length of said communicating channel:

opens into said admission space at end of free piston sliding stroke when said free piston slides in said first direction, leads against free piston external wall during the major part of free piston sliding stroke from beginning when said free piston slides in said first direction, opens into said admission space at beginning of free piston sliding stroke when said free piston slides in said second direction, and leads against free piston external wall during the major part of free piston sliding stroke until end when said free piston slides in said second direction.

8. The thermodynamic cycle process according to claim 1, wherein:

in said powering the liquid pump or the gas compressor with said retrieved energy, said cyclic free piston expander alternatively changes direction of said free piston sliding by alternatively:

closing said fluidic communication between said both opposite sides of said free piston, so as to make different from each other the pressures applied respectively thereon, so that said free piston then slides and accelerates in a first direction, opening a fluidic communication between both opposite sides of said free piston, so as to make equal to each other the pressures applied respectively thereon, so that said free piston then slides and accelerates in a second direction opposite to said first direction, said free piston sliding and accelerating, directly and mechanically, opening and closing, said fluidic communication.

9. The thermodynamic cycle process according to claim 1, wherein:

a first pressure is applied on a first surface of a first side of said free piston toward a first direction of said free piston sliding, and a second pressure is applied on a second surface of a second side of said free piston opposite to said first side toward a second direction of said free piston sliding, said first surface being smaller than said second surface, a first product of said first pressure by said first surface being higher than a second product of said second pressure by said second surface, during a major part of said free piston sliding stroke in said first direction, and the first product of said first pressure by said first surface being lower than second product of said second pressure by said second surface, during a major part of said free piston sliding stroke in said second direction.

10. The thermodynamic cycle process according to claim 1, wherein:

said free piston includes a shoulder reducing a diameter of the free piston, said free piston shoulder being said first surface, said sliding chamber comprises a shoulder reducing a diameter of the sliding chamber, and said admission space is located between said free piston shoulder and said sliding chamber shoulder.

11. The thermodynamic cycle process according to claim 10, wherein said admission space has the shape of an annular compartment of a height which is variable and which height direction is parallel to said sliding directions of said free piston.

12. The thermodynamic cycle process according to claim 10, wherein said admission space is connected to an outside compressed fluid flow, via a simple inlet through a wall of the sliding chamber.

13. The thermodynamic cycle process according to claim 1, wherein said expansion space is located between: (i) a free side of a head of said free piston, said free piston head being opposite to a pin of said free piston, a free side of said free piston pin either exerting a force toward pumping liquid of said liquid pump or toward compressing gas of said gas compressor at both an open extremity of said sliding chamber, and (ii) a closed extremity of said sliding chamber.

14. The thermodynamic cycle process according to claim 13, wherein said expansion space is connected to an outside expanded fluid flow, via a simple outlet through a wall of the sliding chamber.

15. The thermodynamic cycle process according to claim 1, wherein said free piston expander, which is located between a compressed fluid flow and an expanded fluid flow of the thermodynamic cycle process, has all of its pieces which are static except only one piece which is moving, that is the free piston which slides within the static sliding chamber.

16. The thermodynamic cycle process according to claim 1, wherein:

said fluid is one or more of water, carbon dioxide, air, natural gas, organic fluid, ammoniac ($NH_3$), and any mixture thereof.

17. The thermodynamic cycle process according to claim 16, wherein said fluid is carbon dioxide.

18. The thermodynamic cycle process according to claim 1, wherein said free piston pin is either exerting a force toward pumping liquid of said liquid pump or toward compressing gas of said gas compressor at an open extremity of said sliding chamber via an extension arm sliding in a tube having a smaller internal diameter than an internal diameter of said sliding chamber.

19. The thermodynamic cycle process according to claim 1, wherein a ratio of a fluid high pressure before said fluid expansion by a fluid low pressure after fluid expansion, is greater than 20.

20. The thermodynamic cycle process according to claim 1, wherein a fluid high pressure before said fluid expansion, is greater than 50 bars.

21. The thermodynamic cycle process according to claim 1, wherein:

said free piston sliding has an oscillation frequency, and said free piston has a mass which has a value such that said oscillation frequency ranges from 20 Hz to 150 Hz.

22. The thermodynamic cycle process according to claim 1, wherein a fluid temperature during said fluid expansion, goes under 80° C., preferably under 0° C.

23. The thermodynamic cycle process, according to claim 1, wherein said powering powers a positive displacement pump or a positive displacement compressor with said retrieved energy.

24. The thermodynamic cycle process according to claim 1, wherein the thermodynamic cycle includes a phase of adiabatic expansion.

25. The thermodynamic cycle process according to claim 23, wherein said adiabatic expansion phase is more than a half of the whole expansion phase.

26. The thermodynamic cycle process according to claim 24, wherein:

at the beginning of said adiabatic expansion phase, said fluid is in one or more of a liquid state, a mixed state including both liquid and vapor, and a super-critical fluid state.

27. The thermodynamic cycle process according to claim 26, wherein, at the beginning of said adiabatic expansion phase, said fluid is in a super-critical fluid state.

28. The thermodynamic cycle process according to claim 1, wherein:

said thermodynamic cycle process is used in one of a refrigerator, a heat pump, and an air conditioner.

29. The thermodynamic cycle process according to claim 1, wherein:

said thermodynamic cycle process includes a main powering, and said powering of said free piston expander is re-used to perform part of said main powering in said thermodynamic cycle process.

30. The thermodynamic cycle process according to claim 1, wherein:

said thermodynamic cycle process comprises compressing, and in said powering, a compressing portion of said free piston expander performs part of said compressing.

31. The thermodynamic cycle process according to claim 1, wherein said thermodynamic cycle process is one of a Rankine cycle, and an organic Rankine cycle.

* * * * *